US011591835B2

(12) United States Patent
Cheng

(10) Patent No.: US 11,591,835 B2
(45) Date of Patent: Feb. 28, 2023

(54) NARROW BACKSET AUTO-LATCHING MORTISE LOCK FOR SLIDING DOOR

(71) Applicant: Qianyan Cheng, Sacramento, CA (US)

(72) Inventor: Qianyan Cheng, Sacramento, CA (US)

( * ) Notice: Subject to any disclaimer, the term of this patent is extended or adjusted under 35 U.S.C. 154(b) by 148 days.

(21) Appl. No.: 17/197,363

(22) Filed: Mar. 10, 2021

(65) Prior Publication Data

US 2022/0290475 A1 Sep. 15, 2022

(51) Int. Cl.

| | |
|---|---|
| ***E05C 3/12*** | (2006.01) |
| ***E05C 3/00*** | (2006.01) |
| ***E05B 63/08*** | (2006.01) |

(52) U.S. Cl.

CPC ..... *E05C 3/12* (2013.01); *E05B 63/08* (2013.01); *E05C 3/004* (2013.01)

(58) Field of Classification Search

CPC ..... Y10T 292/1059; Y10T 292/0911; Y10T 292/0945; Y10T 292/0926; Y10T 292/0928; Y10T 292/1043; Y10T 292/1075; Y10T 292/1051; Y10T 292/1052; Y10T 292/1097; E05C 3/12; E05C 3/004; E05C 3/045; E05C 3/00; E05C 19/10; E05B 63/08; E05B 63/185; Y10S 292/46; Y10S 292/60

See application file for complete search history.

(56) References Cited

U.S. PATENT DOCUMENTS

| | | | | | |
|---|---|---|---|---|---|
| 1,073,057 | A * | 9/1913 | Schmid | E05C 19/022 | 292/99 |
| 1,075,367 | A * | 10/1913 | Merritt | E05C 19/022 | 292/99 |
| 1,090,305 | A * | 3/1914 | Hoffman | E05B 65/0864 | 70/136 |
| 2,701,156 | A * | 2/1955 | Palmer, Jr. | E05B 65/0817 | 70/95 |
| 2,736,185 | A * | 2/1956 | Collar | E05B 65/0811 | 70/137 |

(Continued)

FOREIGN PATENT DOCUMENTS

| | | | | |
|---|---|---|---|---|
| CA | 2557178 A1 * | 2/2005 | E05B 63/0065 | |
| DE | 202016001540 U1 * | 6/2016 | E05B 15/102 | |

(Continued)

*Primary Examiner* — Kristina R Fulton
*Assistant Examiner* — Steven A Tullia
(74) *Attorney, Agent, or Firm* — Craig A. Simmermon

(57) ABSTRACT

Narrow backset auto-latching mortise lock for sliding door is a mortise lock that is fully contained within a 1.5 inch wide casing or housing that includes actuated automatic latching and automatic unlatching mechanism. Narrow backset auto-latching mortise lock for sliding door is a mortise lock that properly fits a narrow backset sliding door with a backset dimension of 1.25 inches. The design of narrow backset auto-latching mortise lock for sliding door has been elongated so that the latch or bolt is moved downwards and positioned below the lever hub. The positioning of the latch or bolt at a location below the lever hub requires special linkage and mechanical components in order to make the mortise lock function properly. This design required all new lock components, including a new latch lever with a dual hub arm, a dual latch arm, and a dual latch arm pin.

2 Claims, 14 Drawing Sheets

(56) References Cited

U.S. PATENT DOCUMENTS 2,980,458 A * 4/1961 Russell ..... E05B 65/0817 292/113
4,050,272 A * 9/1977 Tanaka ..... E05B 65/0811 292/26
5,820,177 A * 10/1998 Moon ..... E05B 63/20 292/335
6,045,169 A * 4/2000 Frolov ..... E05B 63/202 292/335
6,578,888 B1 * 6/2003 Fayngersh ..... E05B 63/20 70/151 R
7,007,985 B2 * 3/2006 Alexander ..... E05B 59/00 70/486
7,188,870 B2 * 3/2007 Huang ..... E05B 15/10 70/462
7,255,375 B2 * 8/2007 Heid ..... E05B 65/1013 292/93
7,896,407 B2 * 3/2011 Di Vinadio ..... E05B 65/1013 292/93
11,377,874 B2 * 7/2022 Cheng ..... E05B 17/2003
2003/0160463 A1 * 8/2003 Tonges ..... E05B 63/18 292/336.3
2018/0320414 A1 * 11/2018 Piantek ..... E05C 1/04
2018/0340352 A1 * 11/2018 Compton ..... E05B 47/0046
2020/0362594 A1 * 11/2020 Hall ..... E05B 63/185
2021/0054663 A1 * 2/2021 Cheng ..... E05B 63/127
2022/0290475 A1 * 9/2022 Cheng ..... E05B 63/08

FOREIGN PATENT DOCUMENTS

EP 0142342 A2 * 11/1984 ..... E05B 65/0811
EP 0682167 A1 * 4/1995 ..... E05B 55/12
EP 1209307 B1 * 12/2005 ..... E05B 65/0858
EP 3372757 B1 * 4/2021 ..... E05B 17/2034
GB 2586317 A * 2/2021 ..... E05B 59/00
KR 20040104050 A * 6/2003 ..... E05B 59/00
KR 20110008450 U * 2/2010 ..... E05B 15/10
KR 20200111596 A * 7/2019 ..... E05B 17/2007
WO WO-2020245558 A1 * 12/2020 ..... E05B 17/2007

* cited by examiner

NARROW BACKSET AUTO-LATCHING MORTISE LOCK FOR SLIDING DOOR

BACKGROUND OF THE INVENTION

1. Field of the Invention

This invention relates to a mortise lock or a mortise lockset for a sliding door. A mortise lockset is a lockset for a door that requires a pocket or a mortise to be cut into the edge of the door wherein a mortise lock is installed. A mortise lock set may be installed into a hinged door or a sliding door. Specifically, this invention relates to a mortise lock that is installed into a sliding door. The mortise lock of this invention includes a special automatic latching and unlatching mechanism with an actuator button where the whole mechanism is installed within a narrow lock case or housing with a backset dimension that is about 1.25 inches.

2. Description of Related Art

There are many mortise locksets in the prior art however there are none with an actuated automatic latching and automatic unlatching mechanism as shown and described here below. Further, there are no mortise locksets in the prior art with an actuated automatic latching and automatic unlatching mechanism as shown and described here that are small enough to be encased within narrow housing that properly fits within a pocket or mortise with a depth that is less than two inches. This specially designed automatic latching and automatic unlatching mechanism properly fits a narrow backset sliding door with a backset dimension of 1.25 inches. The backset dimension of a door is the distance from the edge of the door to the center of the spindle. The spindle is a length of square metal bar or hexagonal metal bar that passes through the lockset and connects a door knob or lever handles on both side of the door. The door knobs or levers are rotated, which rotates the spindle, in order to latch and unlatch the door. Most doors, including most sliding doors, have a backset of greater than two inches. The greater the backset dimension, the more room there is inside a lockset to house and install the lock and/or latch mechanisms inside. A very select and very limited number of doors in the world have a backset dimension that is less than two inches. Most of these narrow backset doors are intensive care unit sliding doors in a health care facility or hospital. Intensive care unit (ICU) sliding doors at a health care facility or hospital are designed this way in order to save as much space as possible in the ICU. Most, if not all, ICU sliding doors at health care facilities have a backset dimension that is 1.25 inches, whereas most, if not all, other sliding doors in the United States have a backset dimension of 2.375 or 2.75 inches. This narrow 1.25 inch backset design does not leave sufficient room or clearance to install a complicated auto-latching mechanism inside. This invention has solved this problem and includes a specially designed self-latching mechanism, with specially designed and shaped components, including a special actuator, that properly fits within a narrow lock case or housing that is just one to two inches in width and has a backset dimension of only 1.25 inches. The design of mortise lock in this application has been elongated so that the latch or bolt is moved downwards and positioned below the lever hub whereas all other mortise locks have the latch or bolt located even with or directly adjacent to the lever hub. The positioning of the latch or bolt at a location below the lever hub requires special linkage and mechanical components in order to make the mortise lock function properly wherein these special linkage and mechanical components are novel and nonobvious. This design required all new lock components, including a new latch lever with a dual hub arm, a dual latch arm, and a dual latch arm pin. This design also requires a new latch with dual latch arm pin mounting slot which allows the latch to stay in the retracted position when the sliding door is open. All other narrow backset mortise locks in the prior art leave the latch in the extended position when the sliding door is open. This is undesirable because a patient or person or their clothing could inadvertently catch on the extended latch as the person or patient is crossing through the open sliding door. Also, the automatic latching and unlatching mechanism of this invention is specially designed to automatically latch with a positive hook or latch connected to a strike plate, door jam, wall, or frame and automatically unlatch by retracting the hook or latch from the strike plate, door jam, wall, or frame. This automatic latching and unlatching mechanism is also specially designed and shaped to fit within an existing 1.5 inch pocket or mortise with a 1.25 inch backset dimension to retrofit an existing sliding door at an ICU at a health care facility. All other narrow backset mortise locks in the prior art are not actuated with an actuator member and do not automatically latch with a positive hook or latch connected to a strike plate, door jam, wall, or frame when the sliding door is closed.

BRIEF SUMMARY OF THE INVENTION

Narrow backset auto-latching mortise lock for sliding door is a sliding door lock mechanism that is fully contained within a 1.5 inch wide casing or housing.

Narrow backset auto-latching mortise lock for sliding door may be retrofitted into most existing intensive care unit sliding doors.

Narrow backset auto-latching mortise lock for sliding door can be configured to meet the ANSI and BHMA standards for a passage, communicating/patio, and storeroom.

Narrow backset auto-latching mortise lock for sliding door mounts within a mortise pocket of a sliding door and engages with an inside door knob or lever on the inside of a room and engages with an outside door knob or lever on the outside of a room.

It is an aspect of narrow backset auto-latching mortise lock for sliding door to have a mechanism that automatically latches the sliding door when the sliding door is closed.

It is an aspect of narrow backset auto-latching mortise lock for sliding door to have a mechanism that automatically unlatches the sliding door when the inside door knob or door lever is rotated or turned.

It is an aspect of narrow backset auto-latching mortise lock for sliding door to have a mechanism that automatically unlatches the sliding door when the outside door knob or door lever is rotated turned.

It is an aspect of narrow backset auto-latching mortise lock for sliding door to have a latch with a hook to mechanically and positively catch on a strike plate, door jam, wall, or frame.

It is an aspect of narrow backset auto-latching mortise lock for sliding door to have a latch with a hook to mechanically detach and disconnect from a strike plate, door jam, wall, or frame.

It is an aspect of narrow backset auto-latching mortise lock for sliding door to have a latch release actuator with a button that triggers the latch to extend from narrow backset auto-latching mortise lock for sliding door and positively latch or lock onto a strike plate, door jam, wall, or frame when the sliding door is closed.

It is an aspect of narrow backset auto-latching mortise lock for sliding door to have a specially designed and shaped latch lever that retracts the latch into narrow backset auto-latching mortise lock for sliding door and unlatches or unlocks from a strike plate, door jam, wall, or frame when the inside door knob or door lever is rotated or turned.

It is an aspect of narrow backset auto-latching mortise lock for sliding door to have a specially designed and shaped latch lever that retracts the latch into narrow backset auto-latching mortise lock for sliding door and unlatches or unlocks from a strike plate, door jam, wall, or frame when the outside door knob or door lever is rotated turned.

DEFINITION LIST

Figure 1:
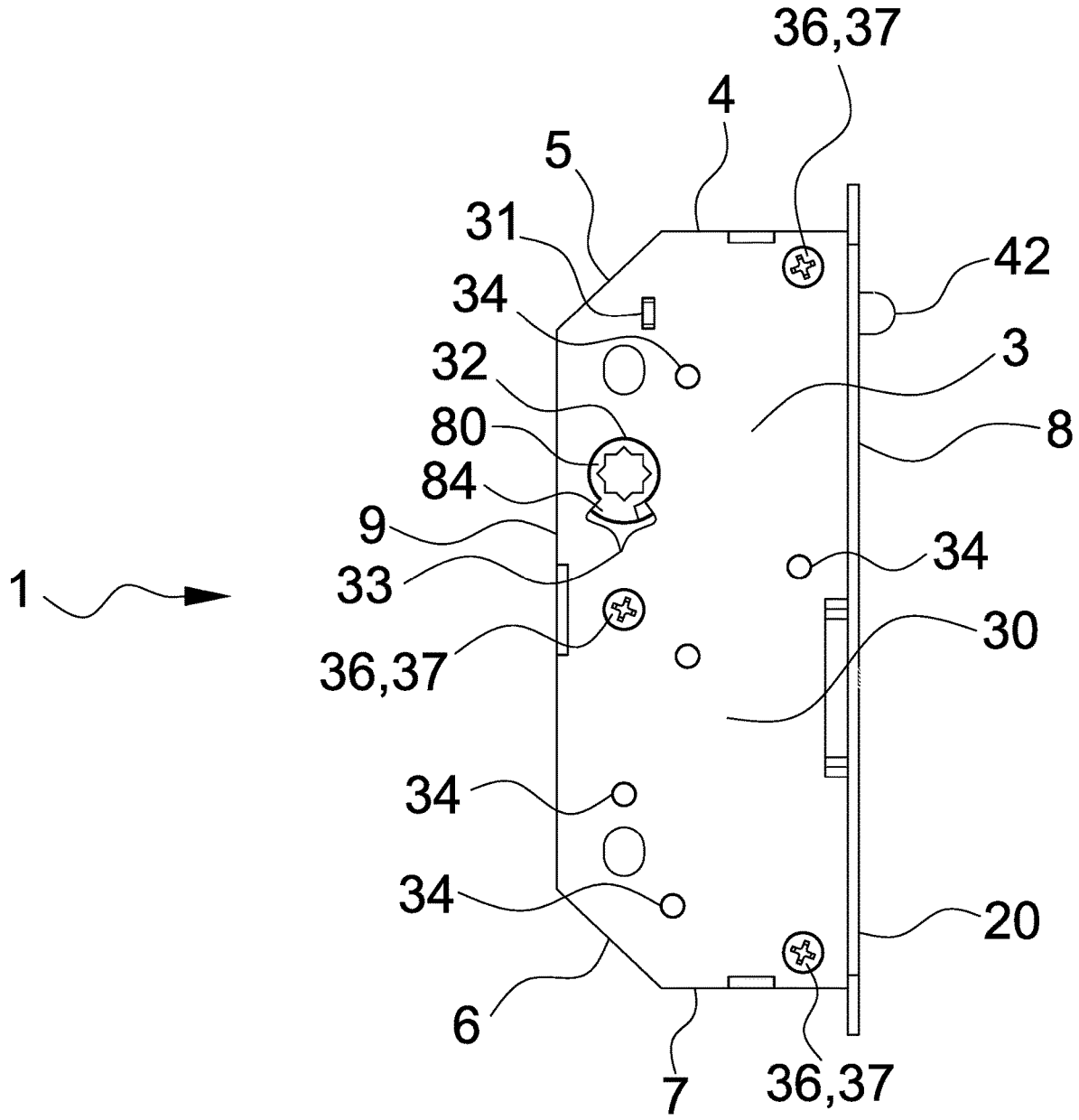
FIG. 1 is a side elevation view of the first side of narrow backset auto-latching mortise lock for sliding door with latch in the retracted, unlatched, or unlocked position.

| Term | Definition |
|---|---|
| 1 | Narrow Backset Auto-Latching Mortise Lock for Sliding Door |
| 2 | First Side of Mortise Lock |
| 3 | Second Side of Mortise Lock |
| 4 | Upper Side of Mortise Lock |
| 5 | Upper Diagonal Side of Mortise Lock |
| 6 | Lower Side of Mortise Lock |
| 7 | Lower Diagonal Side of Mortise Lock |
| 8 | Opening Side of Mortise Lock |
| 9 | Retracting Side of Mortise Lock |
| 10 | Mortise Housing Base (MHB) |
| 11 | Latch Release Actuator Guide Mounting Slot on MHB |
| 12 | Trigger Lever Pivot Pin |

-continued

| Term | Definition |
|---|---|
| 14 | Lever Hub Mounting Hole on MHB |
| 15 | Key Notch on Lever Hub Mounting Hole on MHB |
| 16 | Latch Lever Pivot Pin |
| 17 | Latch Spring Pivot Pin |
| 18 | Latch Pivot Pin |
| 19 | Support Pillar |
| 20 | Mortise Housing Face Plate |
| 22 | Button Clearance Hole on Mortise Housing Face Plate |
| 24 | Latch Clearance Hole on Mortise Housing Face Plate |
| 30 | Mortise Housing Cover Plate (MHCP) |
| 31 | Latch Release Actuator Guide Mounting Slot on MHCP |
| 32 | Lever Hub Mounting Hole on MHCP |
| 33 | Key Notch on Lever Hub Mounting Hole on MHCP |
| 34 | Pin Mounting Hole on Mortise Housing Cover Plate |
| 36 | Screw Hole on Mortise Housing Cover Plate |
| 37 | Mortise Housing Screw |
| 40 | Latch Release Actuator |
| 42 | Button on Latch Release Actuator |
| 44 | Shoulder on Latch Release Actuator |
| 50 | Latch Release Actuator Guide |
| 52 | Guide Hole on Latch Release Actuator Guide |
| 54 | First Tab on Latch Release Actuator Guide |
| 56 | Second Tab on Latch Release Actuator Guide |
| 60 | Trigger Lever |
| 62 | Pivot Hole on Trigger Lever |
| 64 | Upper Arm on Trigger Lever |
| 65 | Spring Tab on Upper Arm of Trigger Lever |
| 66 | Lower Arm on Trigger Lever |
| 67 | Latch Lever Pin on Lower Arm of Trigger Lever |
| 70 | Trigger Lever Spring |
| 80 | Lever Hub |
| 82 | Socket on Lever Hub |
| 83 | First Key Tab on Lever Hub |
| 84 | Second Key Tab on Lever Hub |
| 86 | Trigger Lever Spring Arm on Lever Hub |
| 88 | Latch Retraction Arm on Lever Hub |
| 90 | Latch Lever |
| 92 | Pivot Holes on Latch Lever |
| 94 | Trigger Lever Arm on Latch Lever |
| 95 | Notch on Trigger Lever Arm |
| 96 | Dual Hub Arm on Latch Lever |
| 97 | Dual Hub Arm Pin |
| 98 | Dual Latch Arm on Latch Lever |
| 99 | Dual Latch Arm Pin |
| 100 | Latch |
| 102 | Pivot Hole on Latch |
| 104 | Hook on Latch |
| 106 | Dual Latch Arm Pin Mounting Slot |
| 110 | Latch Spring |

DETAILED DESCRIPTION OF THE INVENTION

Narrow backset auto-latching mortise lock for sliding door 1 is a component of or a portion of a mortise lockset. A mortise lockset is a lockset for a door that requires a pocket or mortise to be cut into the edge of the door wherein a mortise lock is installed. A mortise lock set may be installed in a hinged door or a sliding door. A mortise lockset comprises: a mortise lock; a face plate (not depicted); a spindle (not depicted); two knobs (not depicted) or two levers (not depicted); and a strike plate (not depicted). All components of a mortise lockset are usually sold together as a set or kit. The mortise lock, spindle, two knobs or two levers, and face plate are installed into the door (not depicted). The strike plate is installed in the door jamb (not depicted), door frame (not depicted), or wall (not depicted).

Narrow backset auto-latching mortise lock for sliding door 1 is a mortise lock that is installed into a sliding door (not depicted). Narrow backset auto-latching mortise lock for sliding door 1 is a complicated series of mechanical actions encased within a rigid rectangular cuboid shaped case or housing that is installed within the pocket or mortise of a sliding door. A sliding door is any type of door that slides left or right to open and close rather than pivot or rotate to open or close. A sliding door could be a barn door, patio door, French door, pocket door, or any other type of sliding door. Narrow backset auto-latching mortise lock for sliding door 1 is special because it allows the sliding door to automatically latch with a latch 100 when the sliding door is closed and automatically unlatch or retract latch 100, when a door knob or door lever is turned.

A sliding door has a width, a length, and a thickness. A sliding door has a vertical axis running parallel to its length dimension and a horizontal axis running parallel to its width dimension. A sliding door has an inward side, an outward side, an upper side, a lower side, an opening side, and a retracting side. The inward side of the sliding door is the large vertical side or panel side of the sliding door that is adjacent to the interior of the room. The outward side of the sliding door is the large vertical side or panel side of the sliding door that is adjacent to the exterior of the room. The upper side of the sliding door is the horizontal side or edge of the door that is most proximate to the ceiling of the room. The lower side of the sliding door is the horizontal side or edge of the door that is most proximate to the floor of the building. The opening side of the sliding door is the vertical side or edge of the door that parts or slides open to allow passage through the doorway and slides closed to disallow passage through the doorway. The retracting side of the sliding door is the vertical side or edge of the door that is opposite from the opening side of the sliding door. A sliding door may be installed so that it slides open in the left direction or slides open to in right direction.

Figure 2:
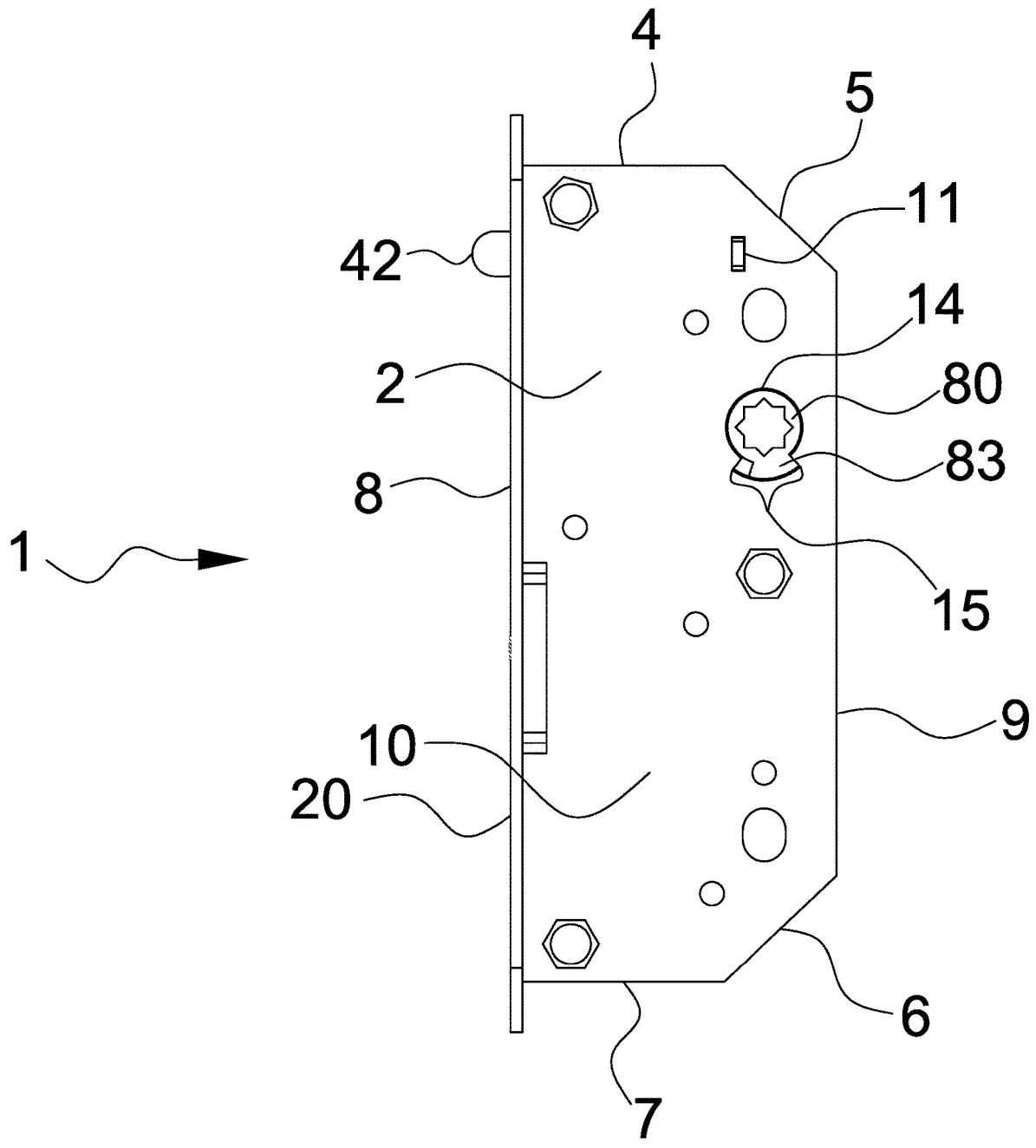
FIG. 2 is a side elevation view of the second side of narrow backset auto-latching mortise lock for sliding door with latch in the retracted, unlatched, or unlocked position.
Figure 3:
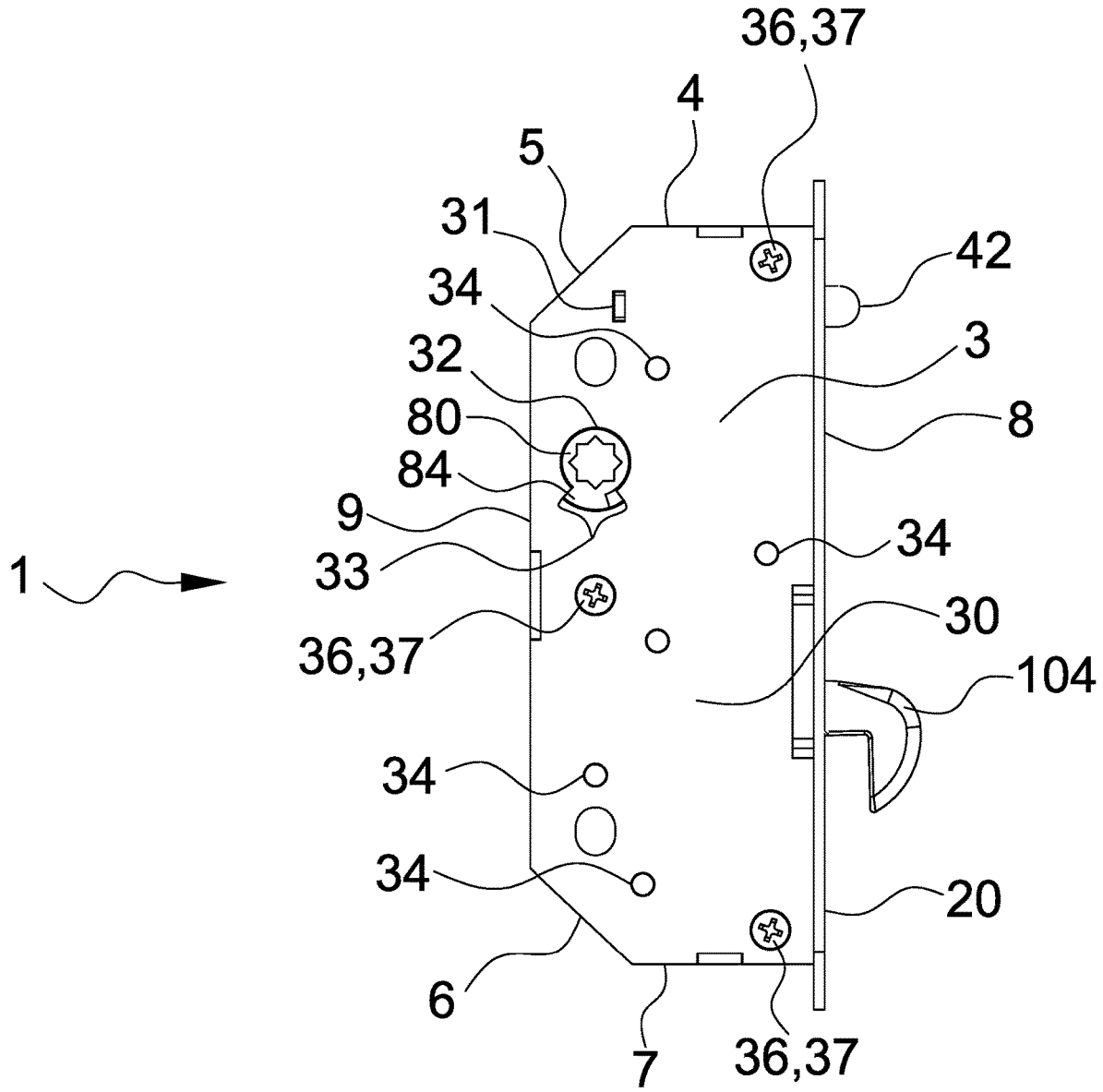
FIG. 3 is a side elevation view of the first side of narrow backset auto-latching mortise lock for sliding door with latch in the extended, latched, or unlocked position.
Figure 4:
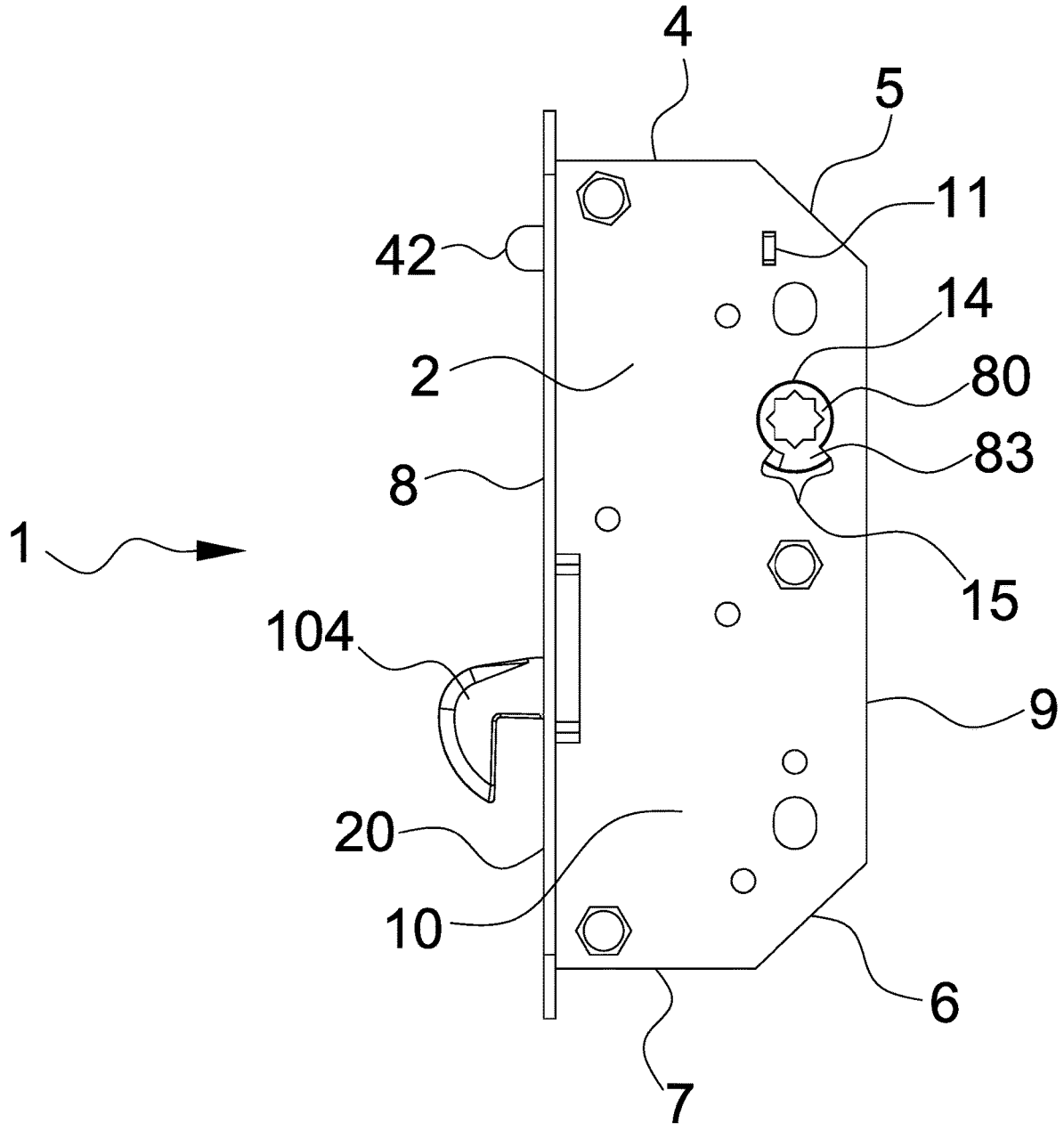
FIG. 4 is a side elevation view of the second side of narrow backset auto-latching mortise lock for sliding door with latch in the extended, latched, or unlocked position.
Figure 5:
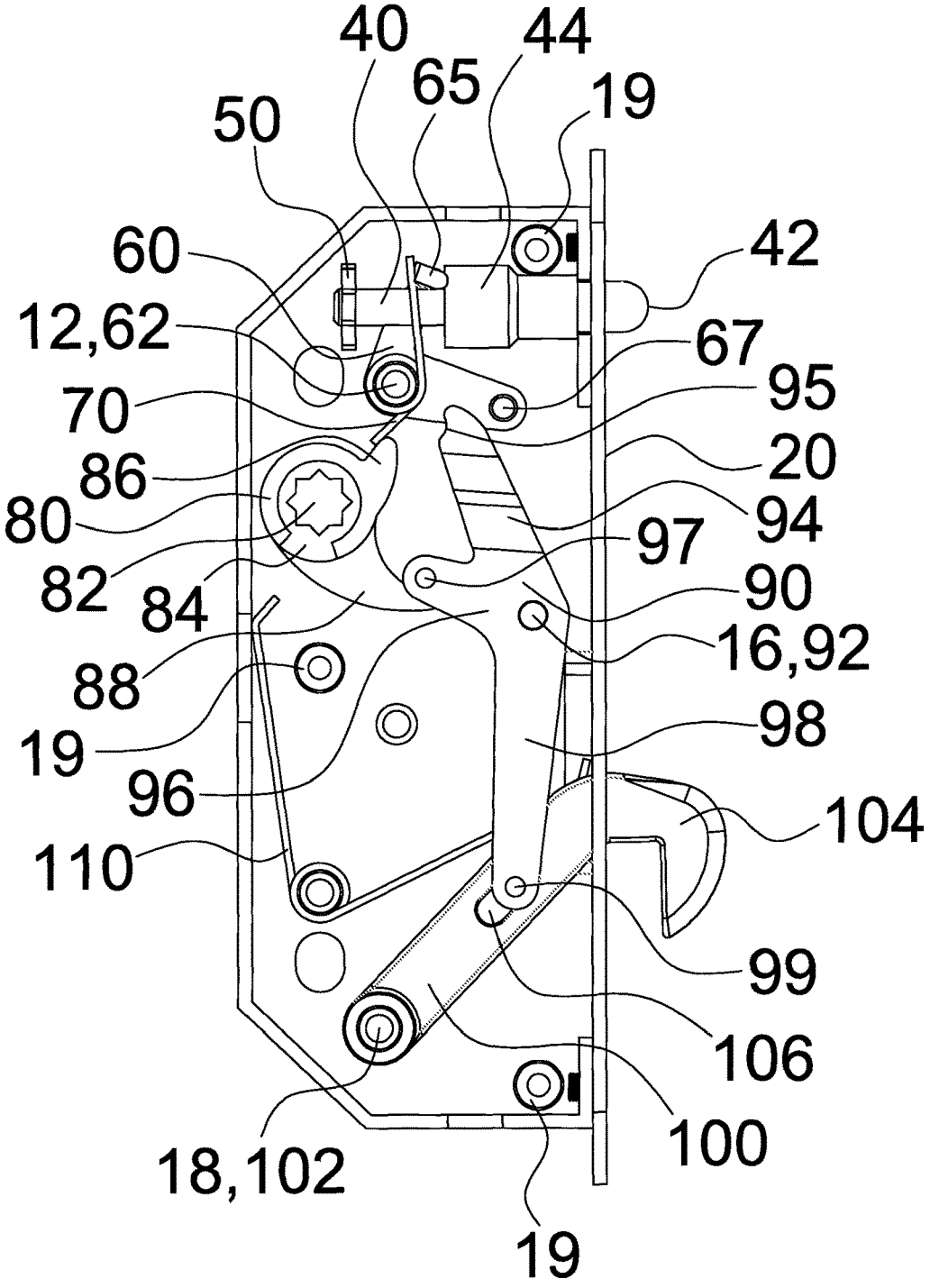
FIG. 5 is a side elevation view of the first side of narrow backset auto-latching mortise lock for sliding door with the mortise housing cover plate removed and latch in the extended, latched, or unlocked position.
Figure 6:
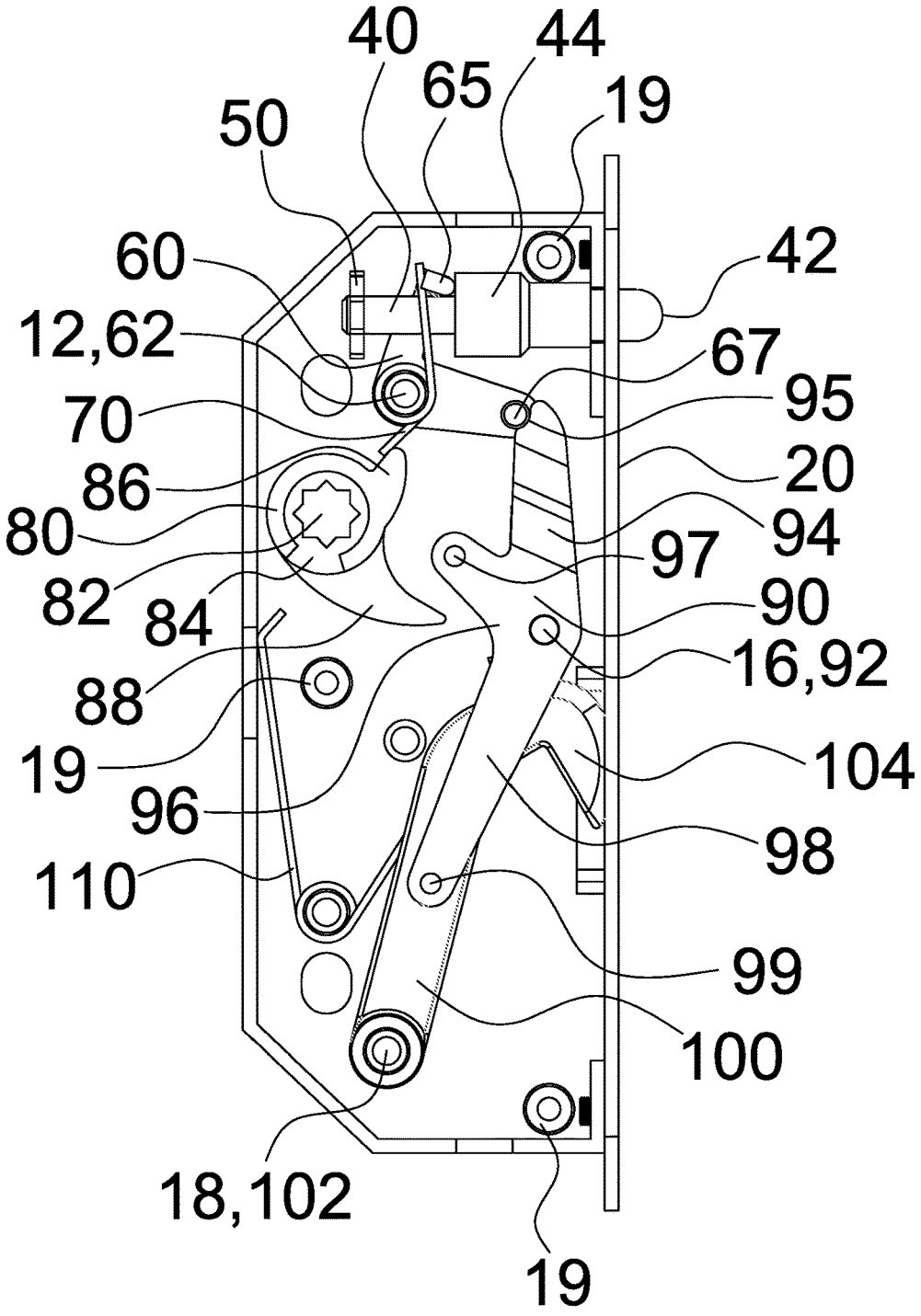
FIG. 6 is a side elevation view of the first side of narrow backset auto-latching mortise lock for sliding door with the mortise housing cover plate removed and latch in the retracted, unlatched, or unlocked position.
Figure 7:
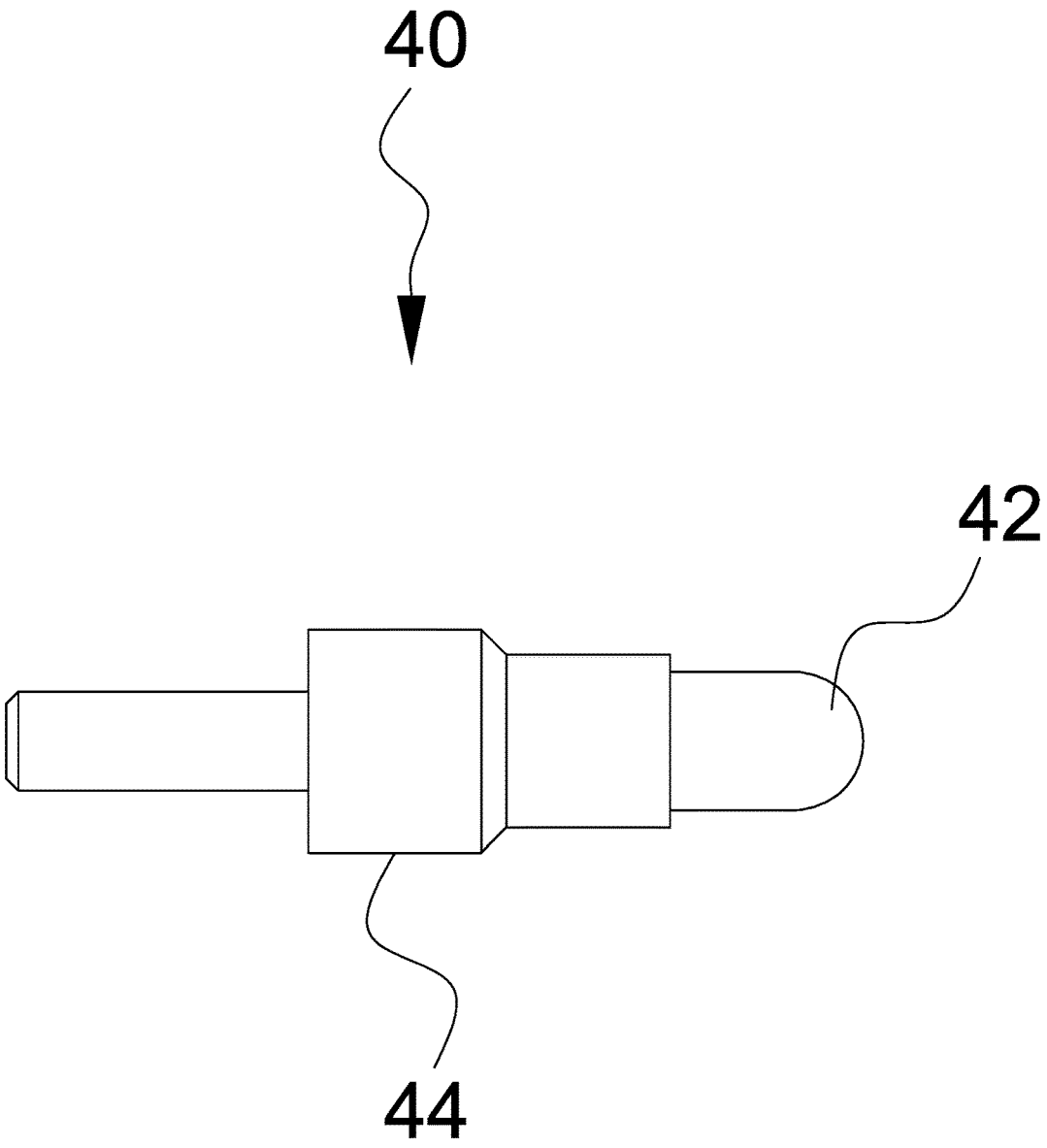
FIG. 7 is a side elevation view of latch release actuator.
Figure 8:
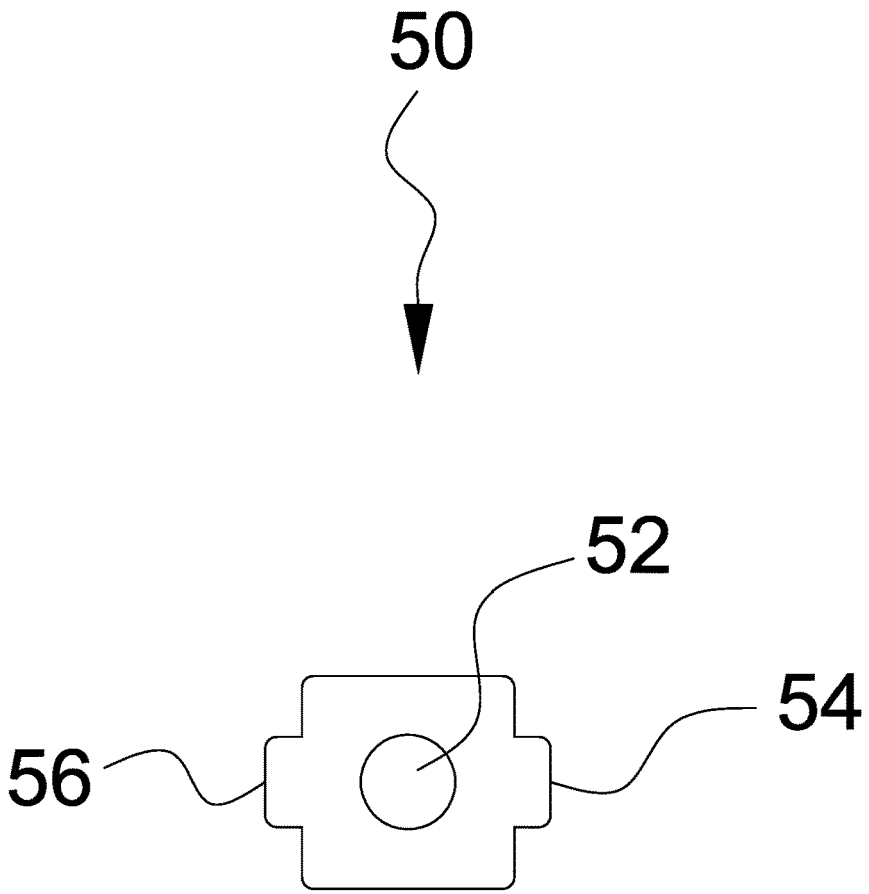
FIG. 8 is a side elevation view of latch release actuator guide.
Figure 9:
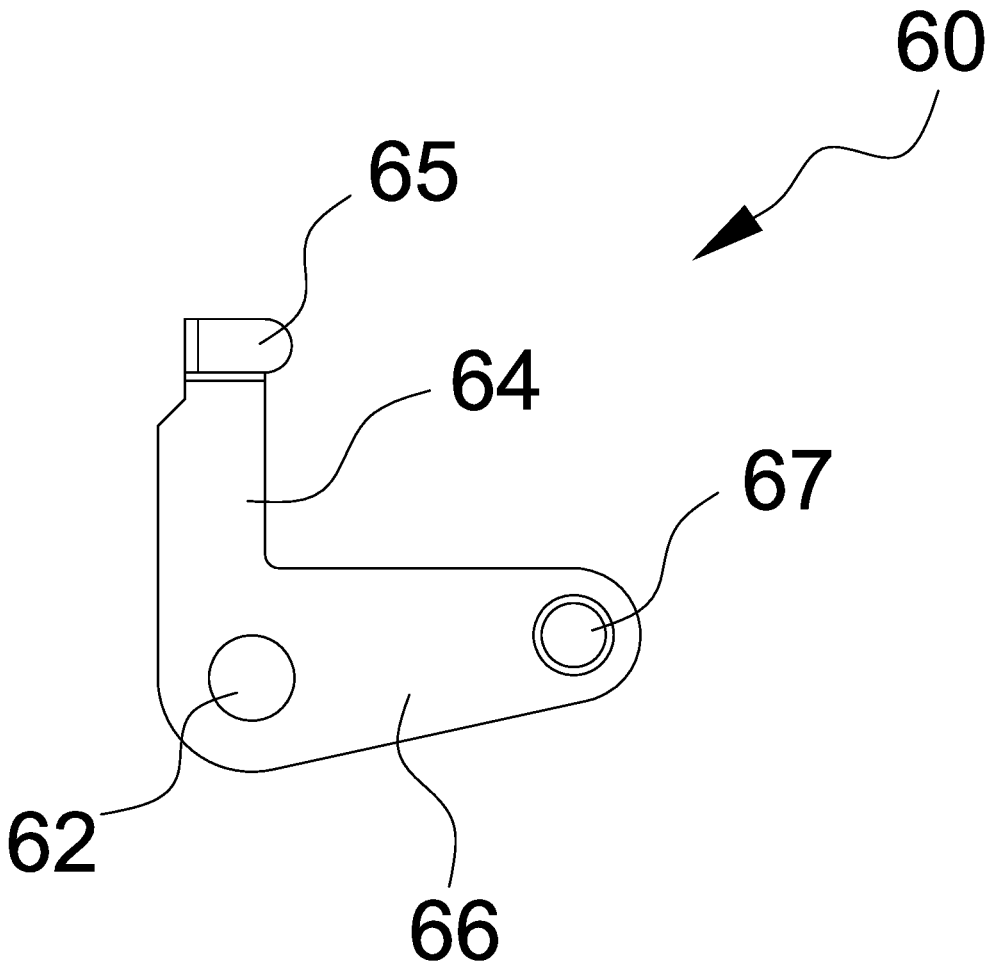
FIG. 9 is a side elevation view of trigger lever.

Mortise housing base 10, mortise housing face plate 20, and mortise housing cover plate 30 are attached together to form a rigid hollow irregular hexagonal prism shaped member or an irregular hexagonal prism shaped case or housing that encases and holds all other components of narrow backset auto-latching mortise lock for sliding door 1, as depicted in FIGS. 1 and 2. The rigid hollow irregular hexagonal prism shaped member or an irregular hexagonal prism shaped case or housing has a width, a length, and a thickness. The width of rigid hollow irregular hexagonal prism shaped member or an irregular hexagonal prism shaped case or housing is less than 2 inches, which is required to properly fit inside an existing pocket or mortise of an existing intensive care unit sliding door to allow this invention to be a full replacement upgrade to an existing mortise lock that does not have the special automatic latching and unlatching mechanism with actuator button of this invention. The rigid hollow irregular hexagonal prism shaped member or an irregular hexagonal prism shaped case or housing has a vertical axis running parallel to its length dimension and a horizontal axis running parallel to its width dimension. Rigid hollow irregular hexagonal prism shaped member or an irregular hexagonal prism shaped case or housing is installed within a pocket or mortise cut into the opening side of the sliding door. Rigid hollow irregular hexagonal prism shaped member or an irregular hexagonal prism shaped case or housing is installed with its vertical axis running vertically and parallel with the vertical axis of the sliding door and its horizontal axis running horizontally and parallel with the horizontal axis of the sliding door. Rigid hollow irregular hexagonal prism shaped member or an irregular hexagonal prism shaped case or housing contains a complicated assembly of various mechanical actions that control the mortise lockset and allow the mortise lockset to function. The complicated assembly of mechanical actions causes the latch 100 and button 42 on latch release actuator 40 to protrude and retract from mortise housing face plate 20 at various times during operation of the mortise lockset.

The rigid hollow irregular hexagonal prism shaped member or an irregular hexagonal prism shaped case or housing has a first side 2, a second side 3, an upper side 4, upper diagonal side 5, a lower side 6, a lower diagonal side 7, an opening side 8, and a retracting side 9 that are each a rigid planar member. First side 2 and second side 3 are the two large vertical sides of narrow backset auto-latching mortise lock for sliding door 1 that are parallel with the inward side and the outward side of the sliding door. The upper diagonal side 5 and the lower diagonal side 7 are the diagonal corner sections at forty-five degree angles, as depicted. First side and second side 3 are parallel with each other. Upper side 4 and lower side 6 are parallel with each other. Opening side 8 and retracting side 9 are parallel with each other. Upper diagonal side 5 is at a forty-five degree angle with opening side 8 and with retracting side 9. Lower diagonal side 7 is at a forty-five degree angle with opening side 8 and with retracting side 9. Upper diagonal side 5 is perpendicular to lower diagonal side 7. The rigid hollow irregular hexagonal prism shaped member or an irregular hexagonal prism shaped case or housing is not a six sided cuboid but rather is an eight sided shape, as depicted, wherein the two cut off forty-five degree angle sections make up the seventh and eight sides.

Narrow backset auto-latching mortise lock for sliding door 1 may be installed with its first side 2 adjacent to the inward side or the outward side of the sliding door. As discussed below, this allows for a single embodiment of narrow backset auto-latching mortise lock for sliding door 1 to be installed in either a "left opening" sliding door or a "right opening" sliding door. The upper side 4 is the horizontal side of narrow backset auto-latching mortise lock for sliding door 1 that is most proximate to the ceiling of the room with narrow backset auto-latching mortise lock for sliding door 1 installed in the sliding door. The lower side 6 is the horizontal side of narrow backset auto-latching mortise lock for sliding door 1 that is most proximate to the floor of the room with narrow backset auto-latching mortise lock for sliding door 1 installed in the sliding door. The opening side 8 is the vertical side of narrow backset auto-latching mortise lock for sliding door 1 that aligns with or is flush with the opening side of the sliding door with narrow backset auto-latching mortise lock for sliding door 1 installed in the sliding door. As discussed below, opening side 8 of narrow backset auto-latching mortise lock for sliding door 1 butts up against or contacts the door jamb or wall when the sliding door is closed and latch 100 and button 42 protrude and retract from opening side 8. The retracting side 9 is the vertical side of narrow backset auto-latching mortise lock for sliding door 1 that is opposite from the opening side 8 and deepest in the pocket or mortise of the sliding door into which the narrow backset auto-latching mortise lock for sliding door 1 is installed. This convention or system of naming sides and edges is carried on throughout this application.

Narrow backset auto-latching mortise lock for sliding door 1 comprises: a mortise housing base 10; a mortise housing face plate 20; a mortise housing cover plate 30; one or more mortise housing screws 37; a latch release actuator 40; a latch release actuator guide 50; a trigger lever 60; a trigger lever spring 70; a lever hub 80; a latch lever 90; a latch 100; and a latch spring 110.

Mortise housing base 10 comprises: a first side, an upper side, an upper diagonal side, a lower side, a lower diagonal side, and a retracting side. Mortise housing base 10 is rigid hollow six-sided shape, as depicted, which makes up six sides of the irregular hexagonal prism shaped case or housing. As discussed below, the mortise housing face plate 20 and the mortise housing cover plate 30 make up the other two sides of the irregular hexagonal prism shaped case or housing.

First side of mortise housing base 10 is the first side 2 of narrow backset auto-latching mortise lock for sliding door 1. First side of mortise housing base 10 is a rigid irregular hexagonal planar member with a length, a width, an inside surface, an outside surface, an upper edge, an upper diagonal edge, a lower edge, a lower diagonal edge, an opening edge, and a retracting edge. The width of first side of mortise housing base 10 is about 1-2 inches. The length of first side of mortise housing base 10 is about 3-6 inches.

Upper side of mortise housing base 10 is the upper side 4 of narrow backset auto-latching mortise lock for sliding door 1. Upper side of mortise housing base 10 is a rigid rectangular planar member with a length, a width, an inside surface, an outside surface, a first edge, a second edge, an opening edge, and a retracting edge. The width of upper side of mortise housing base 10 is about 0.25 to 1 inches. The length of upper side is about 0.25 to 2 inches.

The upper forty-five degree cut off section is the upper diagonal side 5 of narrow backset auto-latching mortise lock for sliding door 1. Upper diagonal side 5 is a rigid rectangular planar member with a length, a width, an inside surface, an outside surface, a first edge, a second edge, an opening edge, and a retracting edge. The width of upper diagonal side 5 is about 0.25 to 1 inches. The length of upper diagonal side 5 is about 0.25 to 1.25 to 1.25 inches.

Lower side of mortise housing base 10 is the lower side 6 of narrow backset auto-latching mortise lock for sliding door 1. Lower side of mortise housing base 10 is a rigid rectangular planar member with a length, a width, an inside surface, an outside surface, a first edge, a second edge, an opening edge, and a retracting edge. The width of lower side of mortise housing base 10 is about 0.25 to 1 inches and equal to that of the upper side. The length of lower side is about 0.25 to 2 inches.

The lower forty-five degree cut off section is the lower diagonal side 7 of narrow backset auto-latching mortise lock for sliding door 1. Lower diagonal side 7 is a rigid rectangular planar member with a length, a width, an inside surface, an outside surface, a first edge, a second edge, an opening edge, and a retracting edge. The width of lower diagonal side 7 is about 0.25 to 1 inches. The length of lower diagonal side 7 is about 0.25 to 1.25 to 1.25 inches.

Retracting side of mortise housing base 10 is the retracting side 9 of narrow backset auto-latching mortise lock for sliding door 1. Retracting side of mortise housing base 10 is a rigid rectangular planar member with a length, a width, an inside surface, an outside surface, a first edge, a second edge, an upper edge, and a lower edge. The width of retracting side of mortise housing base 10 is about 0.25 to 2 inches and equal to that of the upper side of mortise housing base 10. The length of retracting side is about 2 to 6 inches.

As stated, the opening side of mortise housing base 10 is open wherein the mortise housing face plate 20 covers this opening. However, in best mode, the opening side of mortise housing base 10 has an upper tab and a lower tab. The upper tab is adjacent and contiguous with the upper side of mortise housing base 10 as depicted. The lower tab is adjacent and contiguous with the lower side of mortise housing base 10 as depicted. Upper and lower tabs each have a tapped hole thereon that is sized to engage with the thread on a mortise housing screw 37.

Mortise housing base 10 may be made of any known material such as: metal, steel, aluminum, plastic, composite, wood, fiberglass, ceramic, or any other known material. The upper edge of the first side is rigidly attached to the first edge of upper side so that these members are perpendicular to each other and the opening edge of the first side aligns with the opening edge of the upper side and the retracting edge of the first side aligns with the retracting edge of the upper side. Rigid attachment may be accomplished by any known means such as: brake bending, pressed seam, weld, glue, epoxy, adhesive, bolts, screws, rivets, clips, snaps, pins, or fasteners. In best mode, the first side and the upper side of mortise housing base 10 are made from the same sheet of rigid material that is brake bent at ninety degrees to form the first side. The lower edge of the first side is rigidly attached to the first edge of lower side so that these members are perpendicular to each other and the opening edge of the first side aligns with the opening edge of the lower side and the retracting edge of the first side aligns with the retracting edge of the lower side. Rigid attachment may be accomplished by any known means such as: brake bending, pressed seam, weld, glue, epoxy, adhesive, bolts, screws, rivets, clips, snaps, pins, or fasteners. In best mode, the lower side and the first side of mortise housing base 10 are made from the same sheet of rigid material that is brake bent at ninety degrees to form the lower side. The retracting edge of the first side is rigidly attached to the first side of retracting side so that these members are perpendicular to each other and the upper edge of the first side aligns with the upper edge of the retracting side and the lower edge of the first side aligns with the lower edge of the retracting side. Rigid attachment may be accomplished by any known means such as: brake bending, pressed seam, weld, glue, epoxy, adhesive, bolts, screws, rivets, clips, snaps, pins, or fasteners. In best mode, the retracting side and the first side of mortise housing base 10 are made from the same sheet of rigid material that is brake bent at ninety degrees to form the retracting side.

The first side of mortise housing base 10 contains a plurality structures that are used to mount and retain the various components of narrow backset auto-latching mortise lock for sliding door 1 as discussed below. The first side of mortise housing base 10 comprises: a latch release actuator guide mounting slot 11; a trigger lever pivot pin 12; a lever hub mounting hole 14; a latch lever pivot pin 16; a latch spring pivot pin 17; a latch pivot pin 18; and one or more support pillars 19.

Latch release actuator guide mounting slot 11 is an oblong hole or slot in the first side of mortise housing base 10. Latch release actuator guide mounting slot 11 has a width, a length, and a longitudinal axis. The width of latch release actuator guide mounting slot 11 is about 0.0625 to 0.25 inches. The length of latch release actuator guide mounting slot 11 is about 0.125 to 0.5 inches. Latch release actuator guide mounting slot 11 is located adjacent to the upper diagonal edge of the first side of mortise housing base 10 with its longitudinal axis parallel with that of retracting side 9 of mortise housing base 10, as depicted. Latch release actuator guide mounting slot 11 functions as a mounting slot or a track for a latch release actuator guide 50 to be installed therein. As discussed below, the first tab 54 on latch release actuator guide 50 is inserted or installed within latch release actuator guide mounting slot 11 to mount latch release actuator guide to mortise housing base 10.

Trigger lever pivot pin 12 is a solid rigid horizontal cylindrical member with a diameter, a length, a first end, a second end, and a longitudinal axis. The length of trigger lever pivot pin 12 is equal to the width of upper side of mortise housing base 10. Trigger lever pivot pin 12 has a diameter of about 0.0625 to 0.5 inches. The first end of trigger lever pivot pin 12 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of trigger lever pivot pin 12 into a hole in the first side of mortise housing base 10. The second end of trigger lever pivot pin 12 has a shoulder that steps down to a smaller diameter than that of the rest of the pin. Trigger lever pivot pin 12 is located adjacent to the latch release actuator guide mounting slot 11 as depicted. Trigger lever 60 is pivotally attached to trigger lever pivot pin 12.

Lever hub mounting hole 14 is a circular hole in the first side of mortise housing base 10. Lever hub mounting hole 14 has a diameter of about 0.25 to 1.0 inches. Lever hub mounting hole 14 is located just below trigger lever pivot pin 12, as depicted. Lever hub mounting hole 14 functions to receive, hold, and mount lever hub 80. Lever hub 80 is pivotally attached to lever hub mounting hole 14 in mortise housing base 10 as discussed below.

Lever hub mounting hole 14 has a key notch 15 on its circumference. Key notch 15 is notch, void, or crenellation in the first side of mortise housing base 10 along the circumference or perimeter of lever hub mounting hole 14. Key notch 15 has a width. Key notch 15 has an opening end and a retracting end. A first key tab 83 on lever hub 80 engages with key notch 15 and nests within key notch 15 to function as a rotation stop or limiter for lever hub 80 where key tab 83 strikes or contacts the opening end of key notch 15 thereby limiting the rotation of lever hub 80 in that direction and strikes or contacts the retracting end of key notch 15 thereby limiting the rotation of lever hub 80 in the other direction.

Latch lever pivot pin 16 is a solid rigid horizontal cylindrical member with a diameter, a length, a first end, a second end, and a longitudinal axis. The length of latch lever pivot pin 16 is equal to the width of upper side of mortise housing base 10. Latch lever pivot pin 16 has a diameter of about 0.0625 to 0.5 inches. The diameter of latch lever pivot pin 16 is sized to make a slip fit or clearance fit with the diameter of pivot hole 62 on trigger lever 60. The first end of latch lever pivot pin 16 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of latch lever pivot pin 16 into a hole in the first side of mortise housing base 10. The second end of latch lever pivot pin 16 has a shoulder that steps down to a smaller diameter than that of the rest of the pin. Latch lever pivot pin 16 is located near the retracting edge of the first side of mortise housing base 10, as depicted. Latch lever 90 is pivotally attached to latch lever pivot pin 16.

Latch spring pivot pin 17 is a hollow rigid horizontal cylindrical member with an inner diameter, an outer diameter, a length, a first end, a second end, an inside surface, an outside surface, and a longitudinal axis. Latch spring pivot pin 17 has an outer diameter of about 0.125 to 0.5 inches. The length of latch spring pivot pin 17 is equal to the width of upper side of mortise housing base 10. The first end of latch spring pivot pin 17 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of latch spring pivot pin 17 into a hole in the first side of mortise housing base 10. The second end of latch spring pivot pin 17 is a female threaded fitting connection. The inner diameter on the second end of latch spring pivot pin 17 is lined with female thread that engages with male thread on a mortise housing screw 37. Latch spring pivot pin 17 and mortise housing screw 37 function to help attach and support mortise housing cover plate 30 to mortise housing base 10 as discussed below. Latch spring pivot pin 17 is located adjacent to the latch pivot pin 18 as depicted. Latch spring 110 is pivotally attached to latch spring pivot pin 17.

Latch spring pivot pin 17 is a solid rigid horizontal cylindrical member with a diameter, a length, a first end, a second end, and a longitudinal axis. The length of latch spring pivot pin 17 is equal to the width of upper side of mortise housing base 10. Latch spring pivot pin 17 has a diameter of about 0.0625 to 0.5 inches. The first end of latch spring pivot pin 17 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of latch spring pivot pin 17 into a hole in the first side of mortise housing base 10. The second end of latch spring pivot pin 17 has a shoulder that steps down to a smaller diameter than that of the rest of the pin. Latch spring pivot pin 17 is located adjacent to the latch pivot pin 18 as depicted. Latch spring 110 is pivotally attached to latch spring pivot pin 17.

Latch pivot pin 18 is a solid rigid horizontal cylindrical member with a diameter, a length, a first end, a second end, and a longitudinal axis. The length of latch pivot pin 18 is equal to the width of upper side of mortise housing base 10. Latch pivot pin 18 has a diameter of about 0.0625 to 0.5 inches. The first end of latch pivot pin 18 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of latch pivot pin 18 into a hole in the first side of mortise housing base 10. The second end of latch pivot pin 18 has a shoulder that steps down to a smaller diameter than that of the rest of the pin. Latch pivot pin 18 is located adjacent to the latch spring pivot pin 17 as depicted. Latch 100 is pivotally attached to latch pivot pin 18.

Each of one or more support pillars 19 is a hollow rigid horizontal cylindrical member with an inner diameter, an outer diameter, a length, a first end, a second end, an inside surface, an outside surface, and a longitudinal axis. Each of one or more support pillars 19 has an outer diameter of about 0.125 to 0.5 inches. The length of each of one or more support pillars 19 is equal to the width of upper side of mortise housing base 10. The first end of each of one or more support pillars 19 is rigidly attached to the inside surface of the first side of mortise housing base 10 with its longitudinal axis perpendicular to the plane of the first side of mortise housing base 10. Rigid attachment may be accomplished by any known means such as: pressed fit, pressed seam, weld, glue, epoxy, adhesive, bolts, screws, rivets, clips, snaps, pins, or fasteners. In best mode, rigid attachment is accomplished by press fitting or friction fitting the first end of each of one or more support pillars 19 into a hole in the first side of mortise housing base 10. The second end of each of one or more support pillars 19 has a female threaded fitting connection where the inner diameter on the second end of each of one or more support pillars 19 is lined with female thread that engages with male thread on a mortise housing screw 37. One or more support pillars 19 and one or more mortise housing screws 37 function to attach and support mortise housing cover plate 30 to mortise housing base 10 as discussed below.

Mortise housing face plate 20 is a rigid rectangular planar member with a length, a width, an inside surface, an outside surface, a first edge, a second edge, an upper edge, and a lower edge. The width of mortise housing face plate 20 is about 0.5 to 1.5 inches and is slightly wider than the upper side of mortise housing base 10. The length of mortise housing face plate 20 is about 2-6 inches and is slightly longer than the first side of mortise housing base 10. Mortise housing face plate 20 may be made of any known material such as: metal, steel, aluminum, plastic, composite, wood, fiberglass, ceramic, or any other known material.

Mortise housing face plate 20 is reversibly attachable to mortise housing base 10. Mortise housing face plate 20 is reversibly attached to mortise housing base 10 with its plane perpendicular to that of the first side of mortise housing base 10, and its first edge aligned with and adjacent to the opening edge of the first side of mortise housing base 10 and its second edge aligned with and adjacent to the opening edge of mortise housing cover plate 30. Reversible attachment may be accomplished by any known means such as: bolts, screws, clips, snaps, pins, fasteners, or any other means. In best mode, mortise housing face plate 20 is attached to mortise housing base 10 by inserting a mortise housing screw 37 through each of two screw holes on the mortise housing face plate 20 and installing each screw into the tapped hole on each of the upper and lower tabs on mortise housing base 10. When attached, mortise housing face plate 20 is the opening side 8 of narrow backset auto-latching mortise lock for sliding door 1. Mortise housing face plate 20 comprises: a button clearance hole 22 and a latch clearance hole 24.

Button clearance hole 22 is a circular hole in mortise housing face plate 20. Button clearance hole 22 has diameter of about 0.125 to 1.0 inches. Button clearance hole 22 could also be a rectangular or square hole in mortise housing face plate 20. Button clearance hole 22 has a width of about 0.125 to 1.0 inches and length of about 0.125 to 1.0 inches. Button clearance hole 22 is located adjacent to the upper edge of mortise housing face plate 20. Button clearance hole 22 functions to provide a clearance hole through mortise housing face plate 20, through which button 42 on latch release actuator 400 protrudes out of and retracts into in order to latch and unlatch narrow backset auto-latching mortise lock for sliding door 1 as discussed below.

Latch clearance hole 24 is a rectangular or square hole in mortise housing face plate 20. Latch clearance hole 24 has a width of about 0.125 to 1.0 inches and length of about 0.25 to 2.0 inches. Latch clearance hole 24 could also be a circular hole in mortise housing face plate 20. Latch clearance hole 24 has diameter of about 0.125 to 2.0 inches. Latch clearance hole 24 is located adjacent to the lower edge of mortise housing face plate 20. Latch clearance hole 24 functions to provide a clearance hole through mortise housing face plate 20, through which latch 100 protrudes out of and retracts into in order to latch and unlatch narrow backset auto-latching mortise lock for sliding door 1 as discussed below.

Mortise housing cover plate 30 is a rigid irregular hexagonal planar member with a length, a width, an inside surface, an outside surface, an upper edge, an upper diagonal edge, a lower edge, a lower diagonal edge, an opening edge, and a retracting edge. The width of mortise housing cover plate 30 is about 1-2 inches. The length of mortise housing cover plate 30 is about 3-6 inches. Mortise housing cover plate 30 is reversibly attachable to mortise housing base 10. Mortise housing cover plate 30 is attached to mortise housing base 10 with its plane perpendicular to that of the upper and lower sides of mortise housing base 10 and parallel with the first side of mortise housing base 10. Mortise housing cover plate 30 is attached to mortise housing base 10 with its upper edge aligned with and adjacent to the second edge of the upper side of mortise housing base 10, its lower edge aligned with and adjacent to the second edge of the lower side of mortise housing base 10, its retracting edge aligned with and adjacent to the second edge of the retracting side of mortise housing base 10, and its opening edge aligned with and adjacent to the second edge of mortise housing face plate 20. Reversible attachment may be accomplished by any known means such as: bolts, screws, clips, snaps, pins, fasteners, or any other means. In best mode, reversible attachment is accomplished by inserting a mortise housing screws 37 through each screw hole 36 and tightening each down onto a support 19, as depicted. When attached, mortise housing cover plate 30 is the second side 3 of narrow backset auto-latching mortise lock for sliding door 1. Mortise housing cover plate 30 may be made of any known material such as: metal, steel, aluminum, plastic, composite, wood, fiberglass, ceramic, or any other known material. Mortise housing cover plate 30 comprises: a latch release actuator guide mounting slot 31; a lever hub mounting hole 32; a plurality of pin mounting holes 34; and a plurality of screw holes 36.

Latch release actuator guide mounting slot 31 is an oblong hole or slot in mortise housing cover plate 30. Latch release actuator guide mounting slot 31 has a width, a length, and a longitudinal axis. The width of latch release actuator guide mounting slot 31 is about 0.0625 to 0.25 inches. The length of latch release actuator guide mounting slot 31 is about 0.125 to 0.5 inches. Latch release actuator guide mounting slot 31 is located adjacent to the upper diagonal edge of mortise housing cover plate 30 with its longitudinal axis parallel with that of retracting side 9 of mortise housing base 10, as depicted. Latch release actuator guide mounting slot 31 functions as a mounting slot or a track for a latch release actuator guide 50 to be installed therein. The first tab 54 on latch release actuator guide 50 is inserted or installed within latch release actuator guide mounting slot 11 on mortise housing base 10 and the second tab 56 on latch release actuator guide 50 is inserted or installed within latch release actuator guide mounting slot 31 on mortise housing cover plate 30 to install latch release actuator guide in narrow backset auto-latching mortise lock for sliding door 1.

Lever hub mounting hole 32 is a circular hole in mortise housing cover plate 30. Lever hub mounting hole 32 has a diameter of about 0.25 to 1.0 inches. Lever hub mounting hole 32 is located just below latch release actuator guide mounting slot 31, as depicted. Lever hub mounting hole 32 functions to receive, hold, and mount lever hub 80. Lever hub 80 is pivotally attached to lever hub mounting hole 14 in mortise housing base 10 and lever hub mounting hole 32 in mortise housing cover plate 30.

Lever hub mounting hole 32 has a key notch 33 on its circumference. Key notch 33 is notch, void, or crenellation in mortise housing cover plate 30 along the circumference or perimeter of lever hub mounting hole 32. Key notch 15 has a width. Key notch 33 has an opening end and a retracting end. A second key tab 84 on lever hub 80 engages with key notch 33 and nests within key notch 33 to function as a rotation stop or limiter for lever hub 80 where key tab 84 strikes or contacts the opening end of key notch 33 thereby limiting the rotation of lever hub 80 in that direction and strikes or contacts the retracting end of key notch 33 thereby limiting the rotation of lever hub 80 in the other direction.

Each of the plurality of pin mounting holes 34 is a circular hole in mortise housing cover plate 30. Each of the plurality of pin mounting holes 34 has a diameter of about 0.0625 to 0.5 inches. Each of the plurality of pin mounting holes 34 functions to receive, hold, and mount the second end of a pin, such as: trigger lever pivot pin 12, latch lever pivot pin 16, latch spring pivot pin 17, or latch pivot pin 18. The second end of each of these pins forms a slip fit or clearance fit within each of the plurality of pin mounting holes 34 when the mortise housing cover plate 30 is installed onto mortise housing base 10. As stated, the second end of each of these pins has a shoulder that steps down to a smaller diameter that slides or fits into each of the plurality of pin mounting holes 34. When the mortise housing cover plate 30 is installed onto mortise housing base 10, the second ends of trigger lever pivot pin 12, latch lever pivot pin 16, latch spring pivot pin 17, or latch pivot pin 18 are flush with the outside surface of mortise housing cover plate 30. This construction adds strength and stability to the pins as they are attached at both their first and second ends.

Each of the plurality of screw holes 36 is a circular hole in mortise housing cover plate 30 with a beveled edge. Each of the plurality of screw holes 36 functions to provide a clearance hole for the first end of a mortise housing screw 37 to pass through and engage with the female thread on a support pillar 19. Each of the plurality of screw holes 36 has an inner diameter of about 0.0625 to 0.5 inches. Each of the plurality of screw holes 36 is located to exactly align with the second end of each support pillar 19. The beveled edge on each screw hole 36 allows the head of each mortise housing screw 37 to be counter sunk into the mortise housing cover plate 30 and flush with the outside surface of mortise housing cover plate 30 when installed.

Each of one or more mortise housing screws 37 is a screw, bolt, fastener, clip, or similar. Each of one or more mortise housing screws 37 has a first end, a second end, and a longitudinal axis. The first end of each mortise housing screw 37 has male thread that is sized to engage with the female thread on the second end of each support pillar 19. The second end of each mortise housing screw 37 has a head that engages with a tool such as a driver, wrench, socket, bit, or similar. To install mortise housing cover plate 30 to mortise housing base 10, mortise housing cover plate 30 is aligned with mortise housing base 10 and placed onto mortise housing base 10 so that the second ends of trigger lever pivot pin 12, latch lever pivot pin 16, latch spring pivot pin 17, or latch pivot pin 18 each align with a pin mounting hole 34 and are inserted therein, and the second ends of each support pillar 19 align with a screw hole 36, wherein mortise housing screws 37 are installed and tighten down onto support pillars 19. Installing the mortise housing cover plate 30 is the last step to assembling the narrow backset auto-latching mortise lock for sliding door 1. Before installing the mortise housing cover plate 30, all internal mechanisms and components of narrow backset auto-latching mortise lock for sliding door 1 must first be installed and the mortise housing face plate 20 must first be installed as discussed below.

Latch release actuator 40 is a solid rigid oblong member with a width, a length, a longitudinal axis, a retracting end, a middle section, and an opening end. The width of latch release actuator 40 is about 0.125 to 0.5 inches. The length of latch release actuator 40 is about 0.5 to 2.0 inches. The retracting end of latch release actuator 40 is cylindrical with an outer diameter that is sized to make a slip fit or clearance fit with the inside diameter of the guide hole 52 on latch release actuator guide 50. The opening end of latch release actuator 40 is cylindrical with an outer diameter that is sized to make a slip fit or clearance fit with the inside diameter of the button clearance hole 22 on mortise housing face plate 20. Optionally, the opening end of latch release actuator 40 may be rectangular cuboid shaped with an outer diameter that is sized to make a slip fit or clearance fit with the inside diameter of the button clearance hole 22 on mortise housing face plate 20. Latch release actuator 40 is inserted through and slidably attached to guide hole 52 on latch release actuator guide 50 and inserted through and slidably attached to button clearance hole 22 on mortise housing face plate 20 as depicted. Latch release actuator 40 functions to transfer translational motion of itself into rotational motion of trigger lever 60. The opening end of latch release actuator 40 has a button 42 at the very end. Button 42 is a rigid solid half spherical end. Button 42 is a half spherical end on the opening end of latch release actuator 40. Optionally button 42 may be a rigid solid rectangular cuboid or cube. The outer diameter of button 42 is sized to make a slip fit or clearance fit with the inside diameter of the button clearance hole 22 on mortise housing face plate 20. The middle section of latch release actuator 40 lies in between the retracting end and the opening end of latch release actuator 40. The middle section of latch release actuator 40 has a shoulder 44. Shoulder 44 is a section of latch release actuator with a larger diameter than the rest of latch release actuator 40. The diameter of shoulder is about 1.4 to 2.5 times larger than the diameter of the rest of latch release actuator 40. Shoulder 44 creates a step or ledge along the length of latch release actuator 40 in the middle section of latch release actuator 40. Shoulder 44 functions as a catch or a stop for the spring tab 65 on the upper arm 64 of trigger lever 60 to catch onto. The second arm of trigger lever spring 70 applies pressure or tension to spring tab 65, which in turn applies pressure or tension to shoulder 44, to apply continuous pressure or tension to push latch release actuator 40 out in the extended position. Latch release actuator guide 50 may be made of any known material such as: metal, steel, aluminum, plastic, composite, wood, fiberglass, ceramic, or any other known material.

Latch release actuator guide 50 is a rigid planar member with a first end, a middle section, and a second end. The first end of latch release actuator guide 50 has a first tab 54. First tab 54 is a rigid rectangular planar member. First tab 54 protrudes from the first end of latch release actuator guide 50. First tab 54 has a width and a length. The width and length of first tab 54 is sized to make a slip fit or clearance fit with the width and length of latch release actuator guide mounting slot 11 on mortise housing base 10. The first tab 54 on latch release actuator guide 50 is attached to the latch release actuator guide mounting slot 11 on mortise housing base 10. The second end of latch release actuator guide 50 has a second tab 56. Second tab 56 is a rigid rectangular planar member. Second tab 56 protrudes from the second end of latch release actuator guide 50. Second tab 56 has a width and a length. The width and length of second tab 56 is sized to make a slip fit or clearance fit with the width and length of latch release actuator guide mounting slot 31 on mortise housing cover plate 30. The second tab 56 on latch release actuator guide 50 is attached to the latch release actuator guide mounting slot 31 on mortise housing cover plate 3. The middle section of latch release actuator guide 50 has a guide hole 52. Guide hole 52 is a circular hole through latch release actuator guide 50. Guide hole 52 has a diameter that is sized to make a slip fit or clearance fit with diameter of the retracting end of latch release actuator 40. Latch release actuator guide 50 may be made of any known material such as: metal, steel, aluminum, plastic, composite, wood, fiberglass, ceramic, or any other known material.

Trigger lever 60 is a rigid angular member with a center hub; a pivot hole 62; an upper arm 64; and a lower arm 66. Trigger lever 60 is pivotally attached trigger lever pivot pin 12. Trigger lever 60 functions by rotating to release latch lever pin 67 from notch 93 on trigger lever arm 94 on latch lever 90 and also by rotating to catch latch lever pin 67 into notch 93 on trigger lever arm 94 on latch lever 90. Pivot hole 62 is a circular hole through the center hub of trigger lever 60 as depicted. Pivot hole 62 is pivotally attached to trigger lever pivot pin 12. Pivot hole 62 is the center of rotation for trigger lever 60. Pivot hole 62 has a diameter that is sized to make a slip fit or clearance fit with the diameter of trigger lever pivot pin 12. Upper arm 64 is a rigid oblong planar member or arm protruding radially outward from pivot hole 62. Upper arm 64 has a length of about 0.25 to 1.0 inches. When trigger lever 60 is pivotally attached properly, upper arm 64 extends in the direction pointing towards the upper side of mortise housing base 10 as depicted. Upper arm 64 has a spring tab 65 on its radial end. Spring tab 65 is a rigid rectangular planar member that projects perpendicularly outward from the second side of upper arm 64 in the direction pointing towards mortise housing cover plate 30. The plane of spring tab 65 is perpendicular to that of upper arm. Spring tab 65 functions as a catch or stop for the second arm of trigger lever spring 70 and another catch or a stop for the shoulder 44 on latch release actuator 40. Lower arm 66 is a rigid oblong planar member or arm protruding radially outward from pivot hole 62. Lower arm 66 has a length of about 0.25 to 1.0 inches. When trigger lever 60 is pivotally attached properly, lower arm 66 extends in the direction pointing towards the mortise housing face plate 20 as depicted. Lower arm 66 has a latch lever pin 67 on its radial end. Latch lever pin 67 is a rigid solid cylindrical member with a diameter, a length, a first end, a second end, and a longitudinal axis. Latch lever pin 67 extends from the second side of lower arm 66. Latch lever pin 67 extends or protrudes perpendicularly outward from the plane of lower arm 66 in the direction pointing towards mortise housing cover plate 30. Thus, the longitudinal axis of latch lever pin 67 is perpendicular to the plane of lower arm 66. Latch lever pin 67 functions to catch within the notch 93 on latch lever 90 when the latch 100 is in the retracted position and release from the notch 93 on latch lever 90 when the latch 100 is in the extended position. Trigger lever 60 may be made of any known material such as: metal, steel, aluminum, plastic, composite, wood, fiberglass, ceramic, or any other known material.

Trigger lever spring 70 is a torsion spring. Trigger lever spring 70 has a center, a first side arm, and a second arm. The center of trigger lever spring 70 is pivotally attached to trigger lever pivot pin 12 on the first side of mortise housing base 10. The first arm of trigger lever spring 70 extends to contact the trigger lever spring arm 86 on lever hub 80. This contact applies continuous pressure or force to push or rotate lever hub 80 in the counterclockwise direction as viewed from the second side 3 of narrow backset auto-latching mortise lock for sliding door 1. The second arm of trigger lever spring 70 extends to contact the spring tab 65 on the upper arm 64 of trigger lever 60. This contact applies continuous pressure or force to push or rotate trigger lever 60 in the clockwise direction as viewed from the second side 3 of narrow backset auto-latching mortise lock for sliding door 1, causing the spring tab 65 to contact shoulder 44 on latch release actuator 40, applying continuous pressure or force to push latch release actuator 40 towards the mortise housing face plate 20.

Lever hub 80 is a hub or center of a wheel or rotating member. Lever hub 80 is a rigid member with a first side and a second side. The first side of lever hub 80 is installed adjacent to the first side 2 of narrow backset auto-latching mortise lock for sliding door 1. The second side of lever hub 80 is installed adjacent to the second side 3 of narrow backset auto-latching mortise lock for sliding door 1. Lever hub 80 comprises: a socket 82; a first key tab 83; a second key tab 83; a trigger lever spring arm 86; and a latch retraction arm 88. Socket 82 is a hole through the center of lever hub 80. First key tab 83 is a rigid protrusion or tab that extends radially outward from the first side of lever hub 80 located adjacent to socket 82. Second key tab 84 is a rigid protrusion or tab that extends radially outward from the second side of lever hub 80 located adjacent to socket 82. Trigger lever spring arm 86 is a rigid oblong member or arm protruding outward from socket 82. Latch retraction arm 88 is a rigid oblong member or arm protruding outward from socket 82. The first side of lever hub 80 is pivotally attached to lever hub mounting hole 14 on the first side of mortise housing base 10. The second side of lever hub 80 is pivotally attached to lever hub mounting hole 32 on mortise housing cover plate 30. Lever hub 80 functions to transfer rotational motion from the interior door knob (not depicted) or door lever (not depicted) and/or the exterior door knob (not depicted) or door lever (not depicted) to rotational motion of latch lever 90. Lever hub 80 may be made of any known material such as: metal, steel, aluminum, plastic, composite, wood, fiberglass, ceramic, or any other known material.

Socket 82 is a rigid cylindrical hole through lever hub 80. Socket 82 has open ends. Socket 82 runs thorough the center of lever hub 80. Socket 82 has a first end, a second end, an inner diameter, an inner surface, an outer diameter, an outer surface, and a longitudinal axis. Lever hub 80 is pivotally attached to the first side of mortise housing base 10 at the lever hub mounting hole 14 so that the longitudinal axis of socket 82 is perpendicular to the planes of first side of mortise housing base 10 and mortise housing cover plate 30. Lever hub 80 is also pivotally attached to the mortise housing cover plate 30 at the lever hub mounting hole 32 so that the longitudinal axis of socket 82 is perpendicular to the planes of first side of mortise housing base 10 and mortise housing cover plate 30. Socket 82 is the center of rotation for lever hub 80. The outer diameter of the first side of socket 82 is sized to make a slip fit or clearance fit with the diameter of lever hub mounting hole 14. The outer diameter of the second side of socket 82 is sized to make a slip fit or clearance fit with the diameter of and lever hub mounting hole 32. The outer surface of socket 82 is smooth. The inner surface of socket 82 has a plurality of points or ridges that function to engage with a square spindle or shaft or a hexagonal spindle or shaft from a door knob (not depicted) or door lever (not depicted). A spindle or shaft from a door knob or door lever is inserted and installed through socket 82 to form a connection therewith so that lever hub 80 rotates along with the spindle or shaft from the door knob or door lever. A door knob or door lever is not an element of narrow backset auto-latching mortise lock for sliding door 1 but is included with a mortise lock set.

First key tab 83 is on the first side of lever hub 80. First key tab 83 is a rigid tab, protrusion, or catch that extends or protrudes radially outward from the outer diameter of socket 82. First key tab 83 nests within key notch 15 on the first side of mortise housing base 10 to pivotally attach or slidably attach therein. First key tab 83 has a width. First key tab 83 has an opening side and a retracting side. The width of key notch 15 must be larger than that of first key tab 83 so that first key tab 83 may slide back and forth or rotate back and forth within key notch 15. First key tab 83 functions to contact or catch on key notch 15 and thereby limit the rotation of lever hub 80 within lever hub mounting hole 14. When lever hub 80 is rotated one way, the opening side of first key tab 83 contacts the opening end of key notch 15 to prevent any more rotation of lever hub 80 beyond this contact. When lever hub 80 rotates the other way, the retracting side of first key tab 83 contacts the retracting end of key notch 15 to prevent any more rotation of lever hub 80 beyond this contact.

Second key tab 84 is on the second side of lever hub 80. Second key tab 84 is a rigid tab, protrusion, or catch that extends or protrudes radially outward from the outer diameter of socket 82. Second key tab 84 nests within key notch 33 on mortise housing cover plate 30 to pivotally attach or slidably attach therein. Second key tab 84 has a width. Second key tab 84 has an opening side and a retracting side. The width of key notch 33 must be larger than that of second key tab 84 so that second key tab 84 may slide back and forth or rotate back and forth within key notch 33. Second key tab 84 functions to contact or catch on key notch 33 and thereby limit the rotation of lever hub 80 within lever hub mounting hole 32. When lever hub 80 is rotated one way, the opening side of second key tab 84 contacts the opening end of key notch 33 to prevent any more rotation of lever hub 80 beyond this contact. When lever hub 80 rotates the other way, the retracting side of second key tab 84 contacts the retracting end of key notch 33 to prevent any more rotation of lever hub 80 beyond this contact.

Trigger lever spring arm 86 is a rigid oblong member or arm protruding radially outward from the exterior surface of socket 82. When lever hub 80 is pivotally attached properly, trigger lever spring arm 86 extends in the direction pointing upwards towards the corner of narrow backset auto-latching mortise lock for sliding door 1 between the upper side 4 and the opening side 8 of narrow backset auto-latching mortise lock for sliding door 1 as depicted. Trigger lever spring arm 86 has an overall length of about 0.0625 to 0.5 inches. Trigger lever spring arm 86 functions to make continuous contact the first arm of trigger lever spring 70 in order for the trigger lever spring 70 to apply continuous pressure or force to push or rotate lever hub 80 in the counterclockwise direction as viewed from the second side 3 of narrow backset auto-latching mortise lock for sliding door 1 to keep first and second key tabs 83,84 pushed up against and in contact with the opening side of key notches 15,33. This continuous pressure or force transfers to the inside and outside door knobs or levers from the spindle which returns the inside and outside door knobs or levers to their ready positions after they have been rotated to retract, unlatch, or unlock the sliding door.

Latch retraction arm 88 is a rigid oblong member or arm protruding radially outward from the exterior surface of socket 82. When lever hub 80 is pivotally attached properly, latch retraction arm 88 extends in the direction pointing upwards towards the latch clearance hole 24 on mortise housing face plate 20 as depicted. Latch retraction arm 88 has an overall length of about 0.25 to 1.0 inches. Latch retraction arm 88 has width of about 0.125 to 0.5 inches. Latch retraction arm 88 functions to make contact with dual hub arm pin 97 on dual hub arm 96 of latch lever 90 when lever hub 80 is rotated to unlatch the sliding door. As stated, a spindle (not depicted) is inserted or installed within socket 82 of lever hub 80 wherein both the inside and outside knobs or levers (not depicted) are attached to the spindle. When a person rotates the inside and/or outside knob or levers in order to unlatch the sliding door, lever hub 80 is rotated to cause the latch retraction arm 88 to contact the dual hub arm pin 97 to cause the latch lever 90 to rotate, which causes the latch 100 to rotate and retract and also causes the latch lever pin 67 on trigger lever 60 to catch or fall within the notch 93 on rotating latch lever 90 to lock the latch 100 in the retracted position. When the sliding door is closed, the button 42 on latch release actuator 40 contacts the strike plate, door jam, wall, or frame to cause latch release actuator 40 to slide towards the retracting side 9 of narrow backset auto-latching mortise lock for sliding door 1, causing the trigger lever 60 to rotate, causing the trigger lever arm 94 on latch lever 90 to detach or fall clear from latch lever pin 67 on trigger lever 60, causing the latch 100 to extend into the latched position and hook or grab onto the strike plate, door jam, wall, or frame, causing the sliding door to latch.

Latch lever 90 is a rigid angular member with three arms or appendages projecting radially outward from a pivot hole 92. Latch lever 90 is a key component of narrow backset auto-latching mortise lock for sliding door 1 that interacts, links, and connects with the trigger lever 60, the lever hub 80, and the latch 100. Latch lever 90 causes the latch 100 to extend, latch, or lock the sliding door when latch lever 90 is released from the latch lever pin 67 on trigger lever 60. Latch lever 90 also causes the latch 100 to retract, unlatch, or unlock the sliding door when the lever hub 80 is rotated. Latch lever 90 is primarily a dual layer or two layer rigid structure. Latch lever 90 has a first layer and a second layer. The first layer is adjacent to the first side 2 of narrow backset auto-latching mortise lock for sliding door 1. The second layer is adjacent to the second side 3 of narrow backset auto-latching mortise lock for sliding door 1. At the dual layer portions of latch lever 90, the two layers are an exact duplicate or mirror image of each other. The two layers are required to form two prongs or forks that sandwich the latch 100 and properly slidably connect therewith as described below. Latch lever 90 may be made of any known material such as: metal, steel, aluminum, plastic, composite, wood, fiberglass, ceramic, or any other known material. Latch lever 90 has two pivot holes 92; a trigger lever arm 94; a dual hub arm 96; and a dual latch arm 98.

Each pivot hole 92 is a circular hole through the center hub of latch lever 90 as depicted. There are two layers of latch lever 90 at pivot hole 92, and, thus, pivot hole 92 is in fact two holes, one hole through the first layer of latch lever 90 and one hole through the second layer of latch lever 90. Each pivot hole 92 is pivotally attached to latch lever pivot pin 16 where the latch lever pivot pin 16 passes through both pivot holes 92. Each pivot hole 92 has a diameter that is sized to make a slip fit or clearance fit with the diameter of latch lever pivot pin 16. Both pivot holes 92 are the center of rotation for latch lever 90.

Trigger lever arm 94 is a rigid oblong planar member or arm protruding radially outward from pivot hole 92. Trigger lever arm 94 has a length of about 0.5 to 1.5 inches. When latch lever 90 is pivotally attached properly, trigger lever arm 94 extends in the direction pointing towards the upper side of mortise housing base 10 as depicted. Trigger lever arm 94 has a notch 95 on its radial end.

Notch 95 is notch, void, or crenellation on the radial end of trigger lever arm 94 as depicted. Notch 95 has a width that is equivalent to the diameter of latch lever pin 67. Notch 95 functions to receive and hold latch lever pin 67 on trigger lever 60 when latch 100 is in the retracted, unlatched, or unlocked position. When latch lever pin 67 is nested within notch 95, this prevents trigger lever 60 from rotating in the counterclockwise direction as viewed from the second side 3 of narrow backset auto-latching mortise lock for sliding door 1 to hold latch 100 in the retracted, unlatched, or unlocked position. When latch lever pin 67 is not nested within notch 95, trigger lever 60 is free to rotate in the counterclockwise direction as viewed from the second side 3 of narrow backset auto-latching mortise lock for sliding door 1 which places latch 100 in the extended, latched, or unlocked position due to pressure from latch spring 110 as described below.

Dual hub arm 96 is a rigid oblong bi-planar member or dual arm member protruding radially outward from pivot hole 62. The bi-planar aspect of dual hub arm 96 allows the latch retraction arm 88 on lever hub 80 to nest in between the two planes of dual hub arm 96 in order to save space and still make a proper connection with dual hub arm 96. Without the bi-planar aspect or dual arm aspect of dual hub arm 96, dual hub arm 96 would have to connect to latch retraction arm 88 on lever hub 80 at the very end of latch retraction arm 88 and not in the middle of latch retraction arm 88 as depicted. The bi-planar aspect or dual arm aspect of dual hub arm 96 allows the action of the mortise lock to fit inside the narrow backset dimension of 1.25 inches. Dual hub arm 96 has a first planar member and a second planar member that are an exact duplicate or mirror image of each other that form a dual prong or dual fork shape as depicted. The distance between the first and second planar member is sized to make a slip fit or clearance fit with the width of latch retraction arm 88 on lever hub 80. Dual hub arm 96 has a length of about 0.25 to 1.0 inches. When latch lever 90 is pivotally attached properly, dual hub arm 96 extends in the direction pointing towards the retracting side of mortise housing base 10 as depicted. There is a dual hub arm pin 97 at the radial end of dual hub arm 96 attached between the first and second planar members of dual hub arm 96 as depicted.

Dual hub arm pin 97 is a rigid solid cylindrical member with a diameter, a length, a first end, a second end, and a longitudinal axis. Dual hub arm pin 97 is attached or lodged between the first and second planar members of dual hub arm 96. Thus, the longitudinal axis of dual hub arm pin 97 is perpendicular to the planes of dual hub arm 96. This is a press fit or interference fit connection where dual hub arm pin 97 cannot rotate with dual hub arm 96. Dual hub arm pin 97 functions to contact or catch onto latch retraction arm 88 on lever hub 80 as lever hub 80 is rotated from the rest position when latch 100 is in the extended, latched, or locked position. This linkage from latch lever 90 to latch 100 through dual hub arm pin 97 is key to overall elongated design of the mortise lock that allows the mortise lock to fit a 1.25 inch backset dimension. Note that from the rest position, lever hub 80 may only be rotated one way because the trigger lever spring 70 applies continuous force or pressure to return lever hub 80 to the rest position wherein the first and second key tabs 83,84 on lever hub 80 are pushed up against and in contact with the opening side of key notches 15,33 as stated above. When dual hub arm pin 97 is rotated from the rest position with latch 100 in the extended, latched, or locked position, latch retraction arm 88 contacts dual hub arm pin 97, thereby causing latch lever 90 to rotate in the clockwise direction as viewed from the second side 3 of narrow backset auto-latching mortise lock for sliding door 1, which causes latch 100 to move from the extended, latched, or locked into the retracted or unlocked position and also causes the trigger lever arm 94 to rotate so that latch lever pin 67 on trigger lever 60 falls within and catches onto notch 95 on trigger lever arm to catch and hold latch 100 in the retracted or unlocked position. To place latch 100 back into the extended, latched, or locked, the button 42 on latch release actuator must be pressed, which causes the trigger lever to rotate in the counterclockwise direction as viewed from the second side 3 of narrow backset auto-latching mortise lock for sliding door 1, causing the latch lever pin 67 to be raised upwards and lifted out of notch 95, to allow tension from latch spring 110 to rotated latch lever 90 rotate in the counterclockwise direction as viewed from the second side 3 of narrow backset auto-latching mortise lock for sliding door 1, to cause latch 100 rotate in the clockwise direction as viewed from the second side 3 of narrow backset auto-latching mortise lock for sliding door 1, causing latch 100 to fall back into the extended, latched, or lock position.

Dual latch arm 98 is a rigid oblong bi-planar member or dual arm protruding radially outward from pivot hole 62. The bi-planar aspect or dual arm aspect of dual latch arm 98 allows the latch 100 to nest in between the two planes of dual latch arm 98 in order to save space and still make a proper connection with dual latch arm 98. Without the bi-planar aspect or dual arm aspect of dual latch arm 98, dual latch arm 98 would have to connect to latch 100 at the very end of latch 100 and not in the middle of latch 100 as depicted. The bi-planar aspect or dual arm aspect of dual latch arm 98 allows the action of the mortise lock to fit inside the narrow backset dimension of 1.25 inches. Dual latch arm 98 has a first planar member and a second planar member that are an exact duplicate or mirror image of each other that form a dual prong or dual fork shape as depicted. The distance between the first and second planar member is sized to make a slip fit or clearance fit with the width of latch 100. Dual latch arm 98 has a length of about 0.5 to 2.0 inches. When latch lever 90 is pivotally attached properly, dual latch arm 98 extends in the direction pointing towards the lower side of mortise housing base 10 as depicted. Dual latch arm 98 is slidably attached to latch 100 wherein dual latch arm pin 99 is inserted through dual latch arm pin mounting slot 106. There is a dual latch arm pin 99 at the radial end of dual latch arm 98 and in between the first and second planar members of dual latch arm 98. Dual latch arm 98 has a mounting hole on each of the first and second planar members. Dual latch arm pin 99 is installed within these mounting holes on dual latch arm 98 so that dual latch arm pin 99 forms a press fit or clearance fit within the mounting holes as discussed below.

Dual latch arm pin 99 is a rigid solid cylindrical member with a diameter, a length, a first end, a second end, and a longitudinal axis. Dual latch arm pin 99 is attached or lodged between the first and second planar members of dual latch arm 98. Thus, the longitudinal axis of dual latch arm pin 99 is perpendicular to the planes of dual latch arm 98. The diameter of dual latch arm pin 99 is sized to make a slip fit or clearance fit with the width of dual latch arm pin mounting slot 106 on latch 100. Dual latch arm pin 99 functions to slidably attach dual latch arm 98 on latch lever 90 to dual latch arm pin mounting slot 106 on latch 100. Latch lever 90 must be slidably attached to latch 100 prior to installing these members into mortise housing base 10. As discussed below, when latch 100 is in the retracted, unlatched, or unlocked, dual latch arm pin 99 resides at the lower end of dual latch arm pin mounting slot 106 and when latch 100 is in the extended, latched, or locked, dual latch arm pin 99 resides at the upper end of dual latch arm pin mounting slot 106. This design allows the latch lever 90 to connect with latch 100 at the middle of latch 100 instead of at the end of latch 100, thereby saving substantial space within the mortise lock.

Latch 100 is a solid rigid hook shaped member. Latch 100 has an upper end, a middle section, a lower end, and a longitudinal axis. A pivot hole 102 is located at the lower end of latch 100. A hook 104 is located at the upper end of latch 100. A dual latch arm pin mounting slot 106 is located in the middle section of latch 100. Latch 100 is pivotally attached to latch pivot pin 18 on mortise housing base 10 and also slidably attached to dual latch arm 98 on latch lever 90. Latch 100 functions to positively latch, hook, or lock onto the strike plate, door jam, wall, or frame of the sliding door in order to latch or lock the sliding door. Latch 100 may be made of any known material such as: metal, steel, aluminum, plastic, composite, wood, fiberglass, ceramic, or any other known material.

Pivot hole 102 is a circular hole through the lower end of latch 100 as depicted. Pivot hole 102 is pivotally attached to latch pivot pin 18. Pivot hole 102 is the center of rotation for latch 100. Pivot hole 102 has a diameter that is sized to make a slip fit or clearance fit with the diameter of latch pivot pin 18.

Hook 104 is a solid rigid hook shaped member as depicted. Hook 104 is located at the upper end of latch 100. Hook 104 is sized to make a firm connection or attachment to latch, hook, or lock onto the strike plate, door jam, wall, or frame of the sliding door wherein the length of the hook portion is at least 0.25 inches or more. Hook 104 is integral to latch 100 and made from the same piece of material as latch 100.

Figure 10:
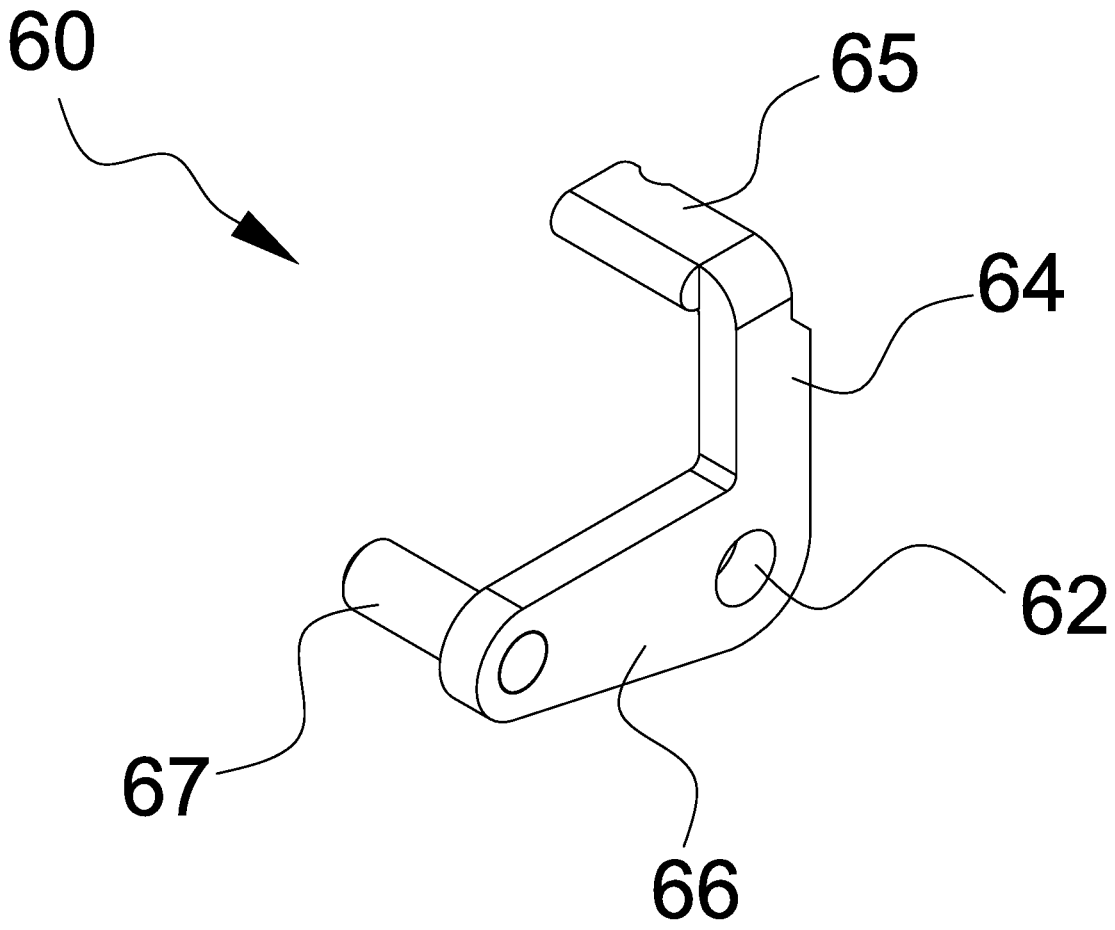
FIG. 10 is a perspective view of trigger lever.
Figure 11:
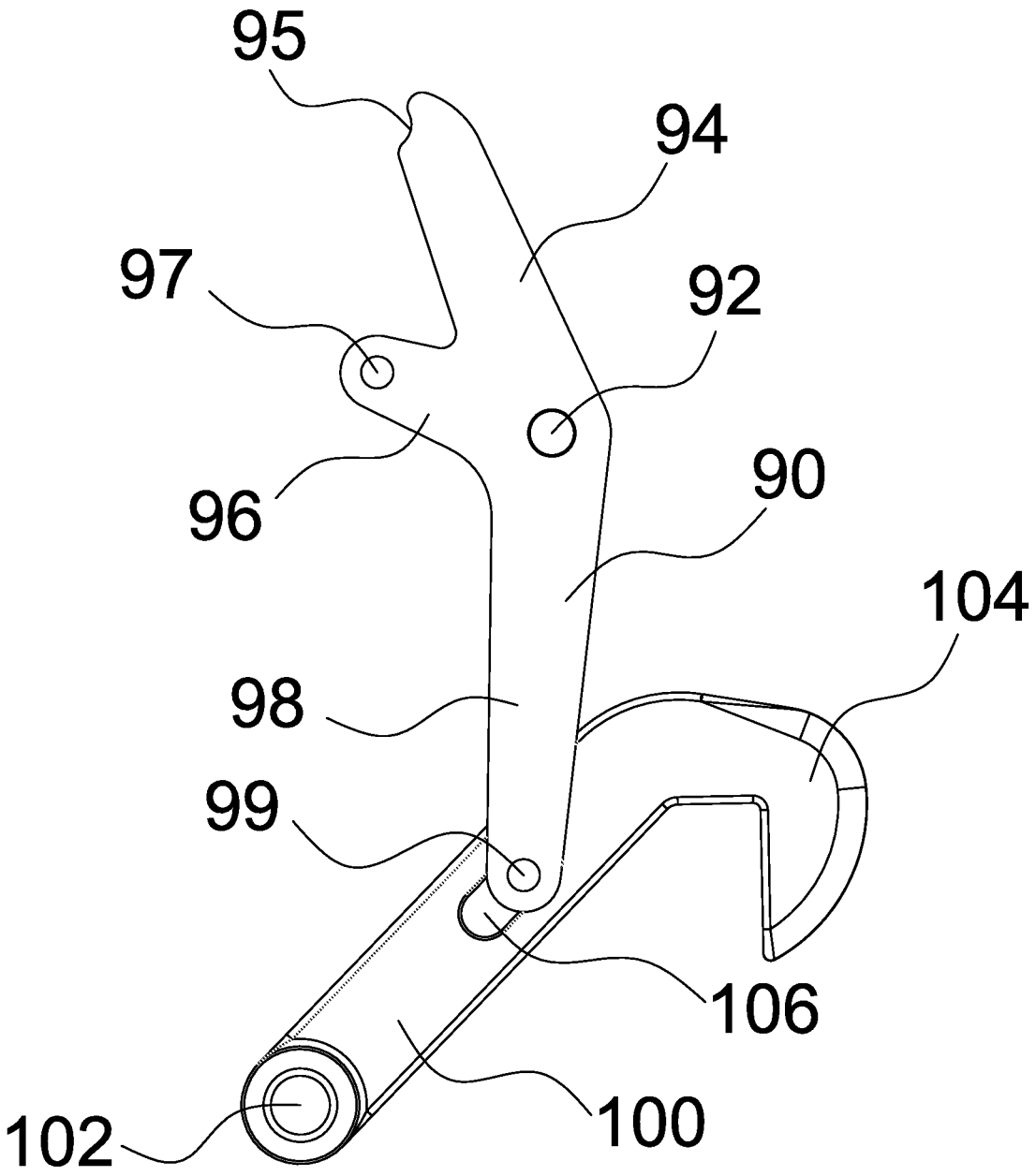
FIG. 11 is a side elevation view of the second side of latch lever slidably attached to latch.
Figure 12:
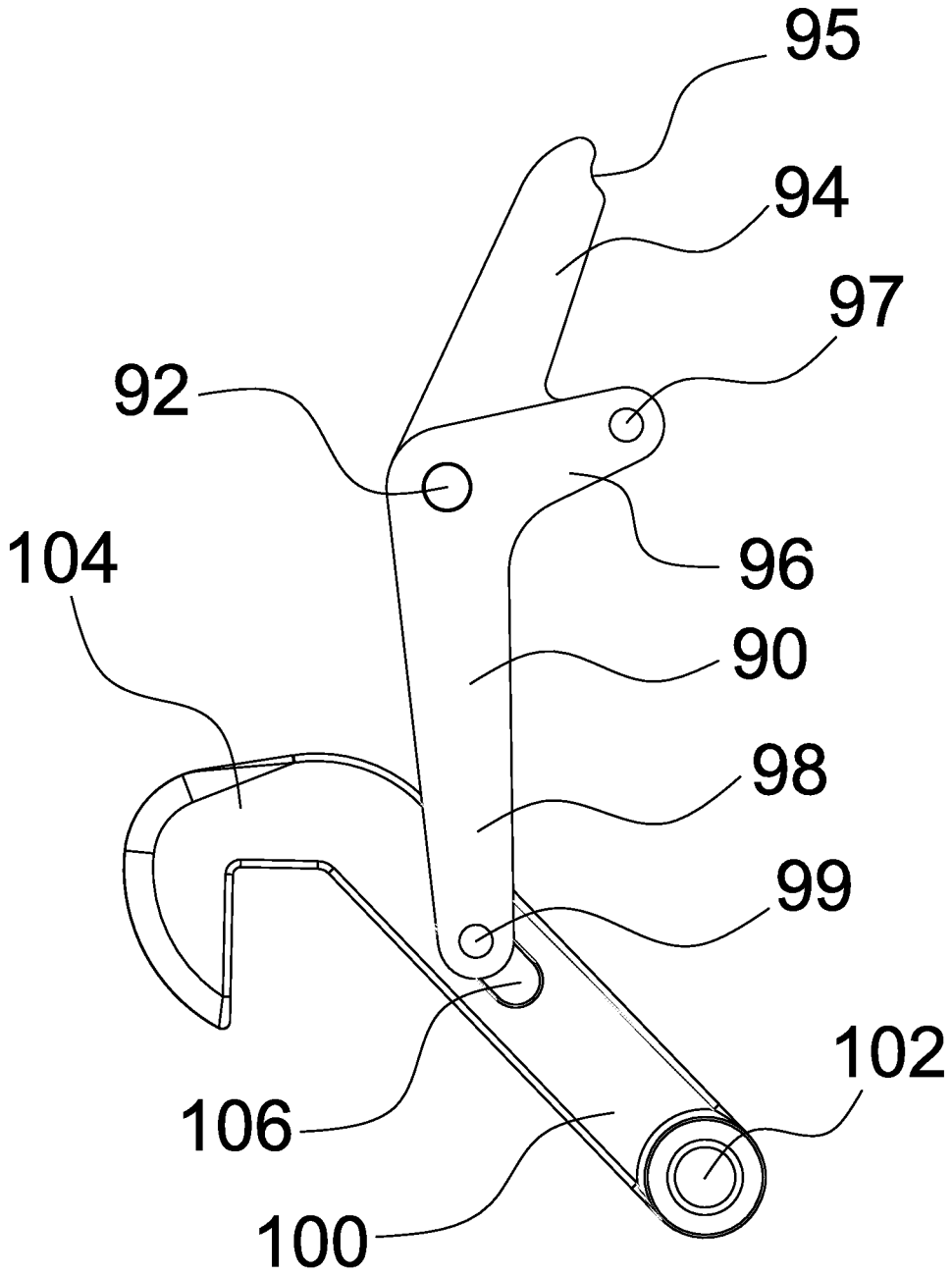
FIG. 12 is a side elevation view of the first side of latch lever slidably attached to latch.
Figure 13:
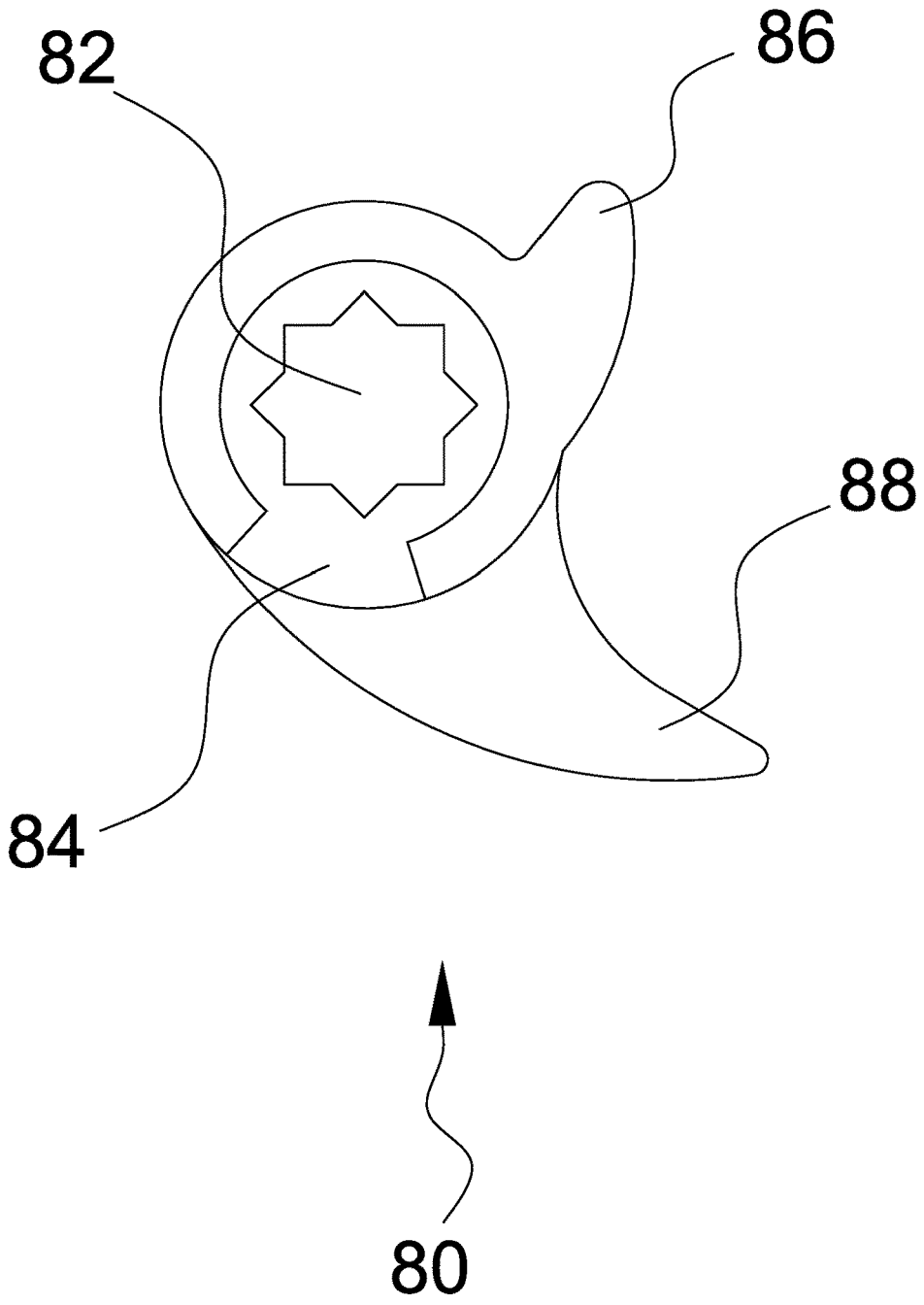
FIG. 13 is a side elevation view of the second side of lever hub.
Figure 14:
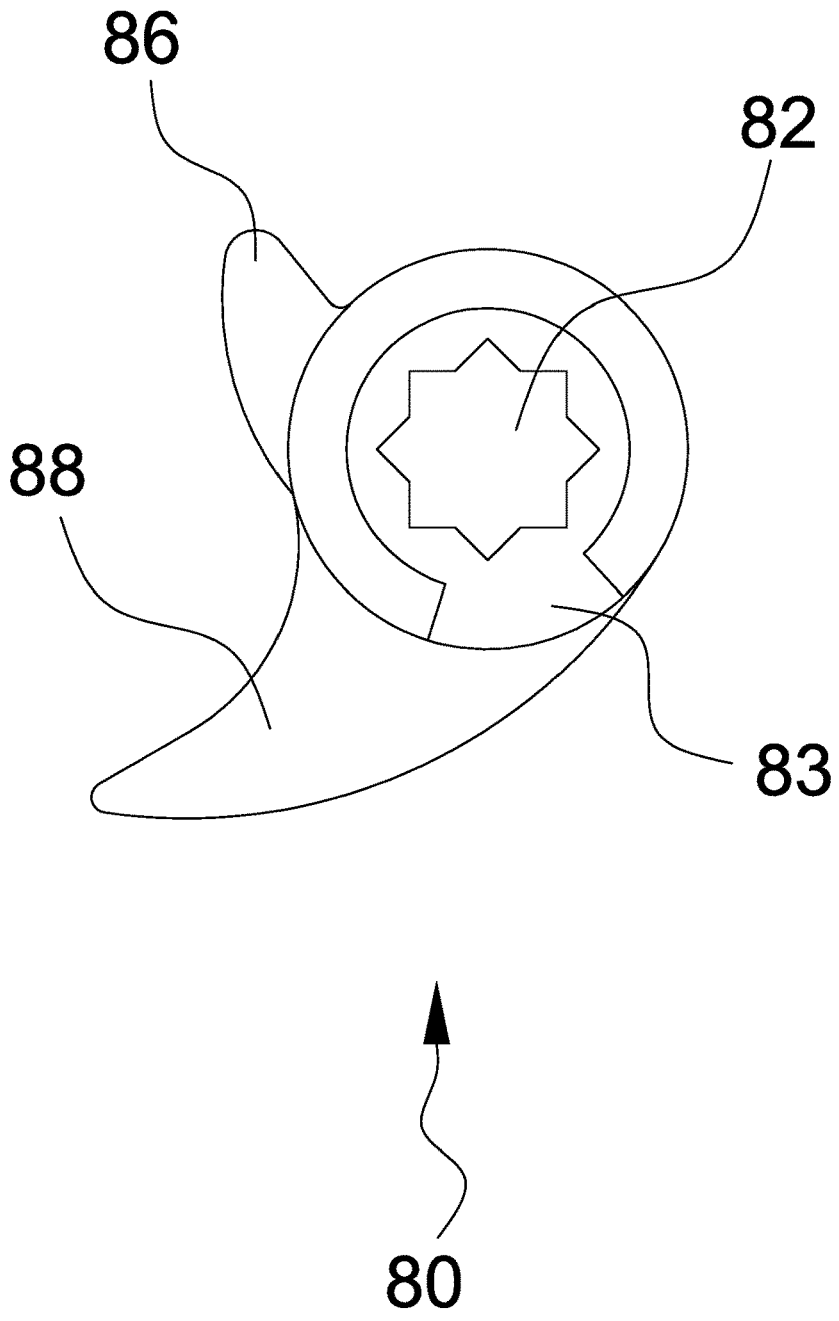
FIG. 14 is a side elevation view of the first side of lever hub.

Dual latch arm pin mounting slot 106 is an oblong hole or slot in the middle section of latch 100. Dual latch arm pin mounting slot 106 has a width, a length, and a longitudinal axis. The width of dual latch arm pin mounting slot 106 is about 0.0625 to 0.25 inches and sized to make a slip fit with the diameter of dual latch arm pin 99. The length of dual latch arm pin mounting slot 106 is about 0.125 to 0.5 inches. Dual latch arm pin mounting slot 106 is located in the middle section of latch 100 with its longitudinal axis parallel with that of latch 100, as depicted. Dual latch arm pin mounting slot 106 functions as a mounting slot or a track for dual latch arm pin 99 to be installed therein. This design allows the latch 100 to connect with latch lever 90 at the middle of latch 100 instead of at the end of latch 100, thereby saving substantial space within the mortise lock. Latch 100 must be slidably attached to latch lever 90 prior to installing these members into mortise housing base 10 as depicted in FIGS. 10 and 11. To slidably attach these members, the middle section of latch 100 is inserted in between the first and second planar members of dual latch arm 98 on latch lever 90 so that each of the two mounting holes for dual latch arm pin 99 on latch lever 90 align with the dual latch arm pin mounting slot 106 on latch 100. Then the dual latch arm pin 99 is inserted and installed through the mounting holes on dual latch arm 98 while also passing through dual latch arm pin mounting slot 106. The diameter of dual latch arm pin 99 is sized to make a press fit or interference fit with the two mounting holes on dual latch arm 98 to make a solid connection therewith wherein dual latch arm pin cannot rotate within the two mounting holes on dual latch arm 98. However, the dual latch arm pin 99 may still freely slide back and forth along the length of dual latch arm pin mounting slot 106 to slidably attach thereto. This slideable attachment is required to properly rotate latch 100 from the extended, latched, or locked position to the retracted, unlatched, or unlocked position and vice versa. After latch 100 is slidably attached to latch lever 90, then this assembly is installed within mortise housing base 10 as with all other components of narrow backset auto-latching mortise lock for sliding door 1.

Latch spring 110 is a torsion spring. Latch spring 110 has a center, a first side arm, and a second arm. The center of latch spring 110 is pivotally attached to latch spring pivot pin 17 on the first side of mortise housing base 10. The first arm of latch spring 110 extends upwards to contact the retracting side of mortise housing base 10 as depicted. The second arm of latch spring 110 extends laterally to contact the retracting side of latch 100 as depicted. This contact applies continuous pressure or force to push or rotate latch 100 in the clockwise direction as viewed from the second side 3 of narrow backset auto-latching mortise lock for sliding door 1. This contact applies continuous pressure or force to push latch into the extended, latched, r locked position. Latch 100 is only held back into the retracted, unlatched, or unlocked position when latch lever 90 is held back by latch lever pin 67 falling and holding within notch 95.

To automatically latch or lock the sliding door, the sliding door can be closed, to cause button 42 on latch release actuator 40 to contact the strike plate, door jam, wall, or frame of the sliding door, which causes the latch release actuator 40 to slide in the latch release actuator guide 50 towards the retracting side 9, which causes the trigger lever 60 to rotate and lift latch lever pin 67 out of notch 95, which allows latch lever to rotate, which causes the latch 100 rotate in the opposite direction, which causes the latch 100 to positively grab onto the strike plate, door jam, wall, or frame to latch or lock the sliding door.

To unlatch or unlock the sliding door, the inside or outside door knob or lever may be rotated, to cause the lever hub 80 to rotate, which causes the latch retraction arm 88 to rotate to make contact with dual hub arm pin 97, which causes the latch lever 90 to rotate, which causes the trigger lever arm 94 to rotate and push up the lower arm 66 on trigger lever 60, which causes the latch lever pin 67 to fall and nest within notch 95 to hold latch lever 90 in this position, which also caused the latch 100 to rotate into the retracted, unlatched, or unlocked position and to be held there as long as latch lever pin 67 is nested within notch 95.

What is claimed is:

1. A narrow backset auto-latching mortise lock for sliding door comprises: a mortise housing base; a mortise housing face plate; a mortise housing cover plate; one or more mortise housing screws; a latch release actuator; a latch release actuator guide; a trigger lever; a trigger lever spring; a lever hub; a latch lever; and a latch, wherein, said mortise housing base comprises: a first side; an upper side; an upper diagonal side; a lower side; a lower diagonal side; and a retracting side, said first side of mortise housing base comprises: a latch release actuator guide mounting slot; a trigger lever pivot pin; a lever hub mounting hole; a latch lever pivot pin; a latch spring pivot pin; a latch pivot pin; and one or more support pillars, said mortise housing face plate is a rigid rectangular planar member with a length; a width; an inside surface; an outside surface; a first edge; a second edge; an upper edge; a lower edge; a button clearance hole; and a latch clearance hole, said mortise housing face plate is reversibly attachable to mortise housing base, said mortise housing cover plate is a rigid irregular hexagonal planar member with a length; a width; an inside surface; an outside surface; an upper edge; an upper diagonal edge; a lower edge; a lower diagonal edge; an opening edge; a retracting edge; a latch release actuator guide mounting slot; a lever hub mounting hole; a plurality of pin mounting holes; and a plurality of screw holes, said mortise housing cover plate is reversibly attachable to mortise housing base, said latch release actuator is a solid rigid oblong member with a width; a length; a longitudinal axis; a retracting end; a middle section; an opening end; a button; and a shoulder, said latch release actuator guide is a rigid planar member with a first tab; a second tab; and a guide hole, said latch release actuator guide is attached to mortise housing base and to mortise housing cover plate, said latch release actuator is inserted through and slidably attached to said guide hole on said latch release actuator guide and inserted through and slidably attached to said button clearance hole on said mortise housing face plate, said trigger lever is a rigid angular member with a center hub; a pivot hole; an upper arm; and a lower arm, said pivot hole on said trigger lever is pivotally attached said trigger lever pivot pin on said first side of said mortise housing base, said trigger lever spring is a torsion spring with a center; a first side arm; and a second arm, said center of said trigger lever spring is pivotally attached to said trigger lever pivot pin on said first side of said mortise housing base, said lever hub is a rigid hub or center of a wheel or rotating member with: first side; a second side; a socket; a first key tab; a second key tab;

said first side of said lever hub is pivotally attached to said lever hub mounting hole on said first side of said mortise housing base, said second side of said lever hub is pivotally attached to said lever hub mounting hole on said mortise housing cover plate, said latch lever is a rigid angular member with: a set of two pivot holes; a trigger lever arm; a dual hub arm; and a dual latch arm, said trigger lever comprises a notch, said dual hub arm comprises a dual hub arm pin, said dual latch arm comprises a dual latch arm pin, each of said set of two pivot holes on said latch lever is pivotally attached to said latch lever pivot pin 16 on said first side of said mortise housing base, said latch is a solid rigid hook shaped member with: a pivot hole; a hook; and a dual latch arm pin mounting slot, said pivot hole on said latch is pivotally attached to said latch pivot pin on said first side of said mortise housing base, and said dual latch arm pin on said latch lever is slidably attached to said dual latch arm pin mounting slot on said latch.

2. A narrow backset auto-latching mortise lock for sliding door as recited in claim 1 further comprising and a latch spring, wherein, said lever hub further comprises: a trigger lever spring arm; and a latch retraction arm, said latch spring is a torsion spring with a center; a first side arm; and a second arm, and said center of said latch spring is pivotally attached to said latch spring pivot pin on said first side of said mortise housing base.

* * * * *